US008152282B2

(12) United States Patent
Uetani et al.

(10) Patent No.: US 8,152,282 B2
(45) Date of Patent: Apr. 10, 2012

(54) DROPLET DISCHARGE DEVICE AND METHOD OF MANUFACTURING DROPLET DISCHARGE DEVICE

(75) Inventors: Masayuki Uetani, Kasugai (JP); Hideki Shimizu, Ohbu (JP)

(73) Assignee: NGK Insulators, Ltd., Nagoya (JP)

( * ) Notice: Subject to any disclaimer, the term of this patent is extended or adjusted under 35 U.S.C. 154(b) by 276 days.

(21) Appl. No.: 12/639,235

(22) Filed: Dec. 16, 2009

(65) Prior Publication Data

US 2010/0091074 A1 Apr. 15, 2010

Related U.S. Application Data

(63) Continuation of application No. PCT/JP2009/056045, filed on Mar. 26, 2009.

(30) Foreign Application Priority Data

Mar. 26, 2008 (JP) ..... 2008-080228

(51) Int. Cl.
*B41J 2/045* (2006.01)

(52) U.S. Cl. ..... 347/70

(58) Field of Classification Search ..... 347/70, 347/71, 72, 68, 69; 29/25.35, 890.1
See application file for complete search history.

(56) References Cited

U.S. PATENT DOCUMENTS

| | | | | |
|---|---|---|---|---|
| 6,217,161 | B1 | 4/2001 | Inose et al. | |
| 6,367,916 | B2 | 4/2002 | Asano | |
| 6,584,660 | B1 * | 7/2003 | Shimogawa et al. | 29/25.35 |
| 6,796,637 | B2 * | 9/2004 | Kitagawa et al. | 347/68 |
| 7,261,862 | B2 | 8/2007 | Noritake et al. | |
| 7,317,276 | B2 * | 1/2008 | Sugahara | 347/68 |
| 2001/0001458 | A1 * | 5/2001 | Hashizume et al. | 347/71 |
| 2004/0256953 | A1 | 12/2004 | Kitagawa et al. | |
| 2006/0138900 | A1 | 6/2006 | Nanataki et al. | |
| 2008/0018716 | A1 | 1/2008 | Noguchi et al. | |
| 2008/0303876 | A1 | 12/2008 | Nihei | |

FOREIGN PATENT DOCUMENTS

| | | | |
|---|---|---|---|
| JP | 05-318747 | A1 | 12/1993 |
| JP | 11-005303 | A1 | 1/1999 |
| JP | 11-048477 | A1 | 2/1999 |
| JP | 11-334071 | A1 | 12/1999 |
| JP | 2000-334947 | A1 | 12/2000 |
| JP | 2001-205815 | A1 | 7/2001 |
| JP | 2001-270114 | A1 | 10/2001 |
| JP | 2002-036538 | A1 | 2/2002 |
| JP | 2003-075305 | A1 | 3/2003 |
| JP | 2005-012200 | A1 | 1/2005 |
| JP | 2005-041054 | A1 | 2/2005 |
| JP | 2005-067047 | A1 | 3/2005 |
| JP | 2006-185950 | A1 | 7/2006 |
| JP | 2008-028030 | A1 | 2/2008 |
| JP | 2008-260269 | A1 | 10/2008 |

* cited by examiner

*Primary Examiner* — Kristal Feggins
(74) *Attorney, Agent, or Firm* — Burr & Brown

(57) ABSTRACT

A droplet discharge device including a plurality of vibrators arranged on an upper surface of a substrate. The substrate has a cavity, discharge hole and supply hole, which serve as a liquid flow path, formed inside a plate including flat upper and lower surfaces. A width of the cavity narrows from the upper surface side toward the lower surface side. A depth of the cavity deepens from the supply hole side toward the discharge hole side. The depth of the cavity may become shallower from the supply hole side toward the discharge hole side in a part which is positioned on the supply hole side and occupies a relatively small area, and the depth of the cavity may become deeper from the supply hole side toward the discharge hole side in a part which is positioned on the discharge hole side and occupies a relatively large area.

18 Claims, 42 Drawing Sheets

FIG. 44

| | SHAPE IN LONGITUDINAL CROSS SECTION OF CAVITY | DEPTH OF CAVITY AT POSITION OF DISCHARGE HOLE (μm) | DEPTH OF CAVITY AT POSITION OF SUPPLY HOLE (μm) | DISCHARGE AMOUNT OF DROPLETS |
|---|---|---|---|---|
| INVENTIVE EXAMPLE 1 | TRAPEDOIDAL | 80 | 40 | 1.83 |
| INVENTIVE EXAMPLE 2 | TRAPEDOIDAL | 80 | 60 | 1.36 |
| COMPARATIVE EXAMPLE 1 | RECTANGULAR | 80 | 80 | 1.00 |

DROPLET DISCHARGE DEVICE AND METHOD OF MANUFACTURING DROPLET DISCHARGE DEVICE

TECHNICAL FIELD

The present invention relates to a droplet discharge device in which vibrators which subject a vibration plate to bending vibration are fixed to the vibration plate of a substrate including a cavity separated from a first main surface by the vibration plate, and to a method of manufacturing the droplet discharge device.

BACKGROUND ART

FIG. 45 to FIG. 47 are schematic views showing a configuration of a conventional droplet discharge device 9. FIG. 45 is a perspective view of the droplet discharge device 9, FIG. 46 is a lateral cross-sectional view of the droplet discharge device 9, which is taken along XLVI-XLVI of FIG. 45, and FIG. 47 is a longitudinal cross-sectional view of the droplet discharge device 9, which is taken along XLVII-XLVII of FIG. 45.

As shown in FIG. 45 to FIG. 47, the droplet discharge device 9 has a structure in which a plurality of vibrators 920 are arranged in a regular manner on an upper surface 9021 of a substrate 902.

As shown in FIG. 46 and FIG. 47, the substrate 902 has a structure in which cavities 908, discharge holes 910 and supply holes 912 which serve as a liquid flow path are formed inside a plate. The cavities 908 are separated from the upper surface 9021 of the substrate 902 by a vibration plate 904. With such a structure, the vibration plate 904 is subjected to bending vibration by the vibrators 920 fixedly installed on an upper surface 9041 of the vibration plate 904, and then liquids filled in the cavities 908 are pressed, whereby droplets are discharged from the discharge holes 910.

As shown in FIG. 46 and FIG. 47, in the conventional droplet discharge device 9, the cavity has uniform lateral width W91, longitudinal width W92 and depth D91. This is because a ceramic green sheet subjected to punching process with a die, a ceramic green sheet subjected to drilling process by a laser beam, or the like was subjected to thermocompression bonding and then subjected to firing to manufacture the substrate 902, and accordingly, inner side surfaces 9081 to 9084 of the cavity 908 have to be perpendicular to the upper surface 9021 of the substrate 902, and an inner lower surface 9086 of the cavity 908 have to be parallel to the upper surface 9021 of the substrate 902.

Patent Document 1 is a prior art reference which describes the invention known to the public through publication concerning a conventional droplet discharge device. Also in a liquid drop emitter described in Patent Document 1, a cavity has uniform width and depth.

Patent Document 2 is a prior art reference which describes the invention known to the public through publication related to the present invention. Patent Document 2 describes a liquid discharge device (inkjet head 1) in which a width of a cavity (ink chamber 5) becomes narrower toward a discharge hole (nozzle 8) side, and a depth of the cavity becomes deeper toward the discharge hole side. In the droplet discharge device of Patent Document 2, an upper end of a vibrator (piezoelectric element 13), in which piezoelectric/electrostrictive films and electrode films are assumed to extend to be perpendicular to a main surface of a substrate and to be alternately laminated, is fixed to a vibration plate (vibration film 3), whereby expansion and contraction of the vibrator in a direction perpendicular to the main surface of the substrate are transmitted to the vibration plate.

Patent Document 1: Japanese Patent Application Laid-Open No. 2003-075305

Patent Document 2: Japanese Patent Application Laid-Open No. 2002-036538

DISCLOSURE OF INVENTION

In the conventional droplet discharge device shown in FIG. 45 to FIG. 47, strength of a frame between the adjacent cavities needs to be secured for preventing crosstalk between adjacent discharge elements. For this reason, it is difficult to increase a discharge amount of droplets by making the width of the vibration plate larger to increase a displacement amount of bending vibration.

Further, the conventional droplet discharge device shown in FIG. 45 to FIG. 47 has a problem that bending vibration of the vibration plate 904 is inhibited due to rigidity of a lower electrode film 922 which is located as the lowermost layer of the vibrator 920 and covers the vibration plate 904, and thus a discharge amount of droplets is prevented from increasing.

Further, according to a conventional method of manufacturing a droplet discharge device, in which a ceramic green sheet subjected to punching process with a die, a ceramic green sheet subjected to drilling process by a laser beam, or the like is subjected to thermocompression bonding and then subjected to firing to manufacture the substrate 902, a three-dimensional shape of the cavity has large limitations. Therefore, it is difficult to form a cavity having a three-dimensional shape which allows an increase in discharge amount of droplets.

Further, in the droplet discharge device of Patent Document 2, in a case where the upper end of the vibrator is fixed to the vibration plate in the course of manufacture of the droplet discharge device, for example, the upper end of the vibrator needs to be pressed against the vibration plate through an adhesive. In addition, also after the droplet discharge device is manufactured, expansion and contraction of the vibrator are transmitted to the vibration plate, whereby there is maintained a state in which the upper end of the vibrator is pressed against the vibration plate. As the vibration plate becomes thinner along with miniaturization of the droplet discharge device, the above-mentioned pressing of the upper end of the vibrator against the vibration plate is likely to cause damage to the vibration plate.

The present invention has been made to solve the above-mentioned problems, and therefore an object thereof is to provide a droplet discharge device in which a discharge amount of droplets is increased and a vibration plate thereof is resistant to damage even if the vibration plate becomes thinner, and a method of manufacturing the droplet discharge device.

In order to solve the above-mentioned problems, a first invention relates to a droplet discharge device including: a substrate including in which a cavity separated from a first main surface by a vibration plate, a first liquid flow path extending from the cavity to an outside, and a second liquid flow path extending from the outside to the cavity are formed; and a vibrator fixed to the vibration plate and subjecting the vibration plate to bending vibration, wherein: a width being a dimension of the cavity in a specific direction parallel to the first main surface becomes narrower from the first main surface side toward a second main surface side; the vibrator includes: a piezoelectric/electrostrictive film extending in parallel to the first main surface; a first electrode film extending in parallel to the first main surface and adhered to the vibration plate by interdiffusion reaction; and a second electrode film extending in parallel to the first main surface and opposed to the first electrode film with the piezoelectric/electrostrictive film being sandwiched therebetween; a width being a dimension of a adhered region in the specific direction to which the first electrode film is adhered is 80% or more and 90% or less of a width being a dimension of the vibration plate in the specific direction; and the vibration plate includes, on both sides of the adhered region, unadhered regions which have equal width being a dimension in the specific direction and to which the first electrode film is not adhered.

According to a second invention, in the droplet discharge device according to the first invention, the width of the cavity becomes narrower in a continuous manner from the first main surface side toward the second main surface side.

According to a third invention, in the droplet discharge device according to the first or second invention: a plurality of unit structures each including the cavity, the first liquid flow path, the second liquid flow path, and the vibrator fixed to the vibration plate separating the cavity from the first main surface of the substrate are arranged; and the width of the cavity in an arrangement direction of the unit structures becomes narrower from the first main surface side toward the second main surface side.

According to a fourth invention, in the droplet discharge device according to any one of the first to third inventions, the substrate is a ceramic substrate obtained by subjecting same types of ceramic to cofiring.

According to a fifth invention, in the droplet discharge device according to any one of the first to fourth inventions, the substrate is a translucent body.

A sixth invention relates to a droplet discharge device including: a substrate in which a cavity separated from a first main surface by a vibration plate, a first liquid flow path extending from the cavity to an outside, and a second liquid flow path extending from the outside to the cavity are formed: and a vibrator fixed to the vibration plate and subjecting the vibration plate to bending vibration, wherein: a depth being a dimension of the cavity in a first direction perpendicular to the first main surface becomes deeper from the second liquid flow path side to the first liquid flow path side; the vibrator includes: a piezoelectric/electrostrictive film extending in parallel to the first main surface; a first electrode film extending in parallel to the first main surface and adhered to the vibration plate by interdiffusion reaction; and a second electrode film extending in parallel to the first main surface and opposed to the first electrode film with the piezoelectric/electrostrictive film being sandwiched therebetween; a width being a dimension in a second direction parallel to the first main surface of an adhered region to which the first electrode film is adhered is 80% or more and 90% or less of a width being a dimension in the second direction of the vibration plate; and the vibration plate includes, on both sides of the adhered region, unadhered regions which have equal width being a dimension in the second direction and to which the first electrode film is not adhered.

According to a seventh invention, in the droplet discharge device according to the sixth invention, the depth of the cavity becomes deeper in a continuous manner from the second liquid flow path side toward the first liquid flow path side.

According to an eighth invention, in the droplet discharge device according the sixth or seventh invention, the substrate is a ceramic substrate obtained by subjecting same types of ceramic to cofiring.

According to a ninth invention, in the droplet discharge device according to any one of the sixth to eighth inventions, the substrate is a translucent body.

A tenth invention relates to a droplet discharge device including: a substrate in which a cavity separated from a first main surface by a vibration plate, a first liquid flow path extending from the cavity to an outside and a second liquid flow path extending from the outside to the cavity are formed: and a vibrator fixed to the vibration plate and subjecting the vibration plate to bending vibration, wherein: in a first part positioned on the second flow path side and occupying a relatively small area, a depth being a dimension of the cavity in a first direction perpendicular to the first main surface becomes shallower from the second liquid flow path side toward the first liquid flow path side; in a second part positioned on the first liquid flow path side and occupying a relatively large area, the depth of the cavity becomes deeper from the second liquid flow path side toward the first liquid flow path side; the vibrator includes: a piezoelectric/electrostrictive film extending in parallel to the first main surface; a first electrode film extending in parallel to the first main surface and adhered to the vibration plate by interdiffusion reaction; and a second electrode film extending in parallel to the first main surface and opposed to the first electrode film with the piezoelectric/electrostrictive film being sandwiched therebetween; a width being a dimension in a second direction parallel to the first main surface of a adhered region to which the first electrode film is adhered is 80% or more and 90% or less of a width being a dimension in the second direction of the vibration plate; and the vibration plate includes, on both sides of the adhered region, unadhered regions which have equal width being the dimension in the second direction and to which the first electrode film is not adhered.

According to an eleventh invention, in the droplet discharge device according to the tenth invention, the depth of the cavity becomes shallower in a continuous manner from the second liquid flow path side toward the first liquid flow path side in the first part; and the depth of the cavity becomes deeper in a continuous manner from the second liquid flow path side toward the first liquid flow path side in the second part.

According to a twelfth invention, in the droplet discharge device according to the tenth or eleventh invention, the substrate is a ceramic substrate obtained by subjecting same types of ceramic are subjected to cofiring.

According to a thirteenth invention, in the droplet discharge device according to any one of the tenth to twelfth inventions, the substrate is a translucent body.

A fourteenth invention relates to a method of manufacturing a droplet discharge device, including the steps of: (a) manufacturing a substrate in which a cavity separated from a first main surface by a vibration plate, a first liquid flow path extending from the cavity toward an outside, and a second liquid flow path extending from the outside to the cavity are formed; and (b) manufacturing a vibrator fixed to the vibration plate and subjecting the vibration plate to bending vibration, wherein the step (a) includes the steps of: (a-1) raising a temperature of a first ceramic green sheet to a glass transition temperature or higher; (a-2) press-fitting a die having a three-dimensional shape corresponding to a three-dimensional shape of the cavity to the first main surface of the first ceramic green sheet after the step (a-1); (a-3) decreasing the temperature of the first ceramic green sheet below the glass transition temperature while keeping a state in which the die is press-fitted to the first main surface of the first ceramic green sheet; (a-4) separating the first ceramic green sheet and the die from each other after the step (a-3); (a-5) thermocompression-bonding a second ceramic green sheet on the first main surface side of the first ceramic green sheet in which a dent is formed by the press-fitting of the die after the step (a-4); and (a-6) subjecting the first ceramic green sheet and the second ceramic green sheet to cofiring after the step (a-5).

According to a fifteenth invention, the method of manufacturing a droplet discharge device according to the fourteenth invention further includes the step (a-7) of forming a ceramic layer outside a region on the first main surface of the first ceramic green sheet in which the dent is formed prior to the step (a-1).

According to a sixteenth invention, in the method of manufacturing a droplet discharge device according to the fifteenth invention, a glass transition temperature of the ceramic layer is lower than the glass transition temperature of the first ceramic green sheet.

According to a seventeenth invention, the method of manufacturing a droplet discharge device further includes the step (a-8) of forming a through hole piercing from an inner surface of the dent formed on the first main surface of the first ceramic green sheet to a second main surface after the step (a-4).

According to an eighteenth invention, in the method of manufacturing a droplet discharge device according to any one of the fourteenth to seventeenth inventions, the step (b) includes the steps of (b-1) forming a photosensitive film on the first main surface of the substrate; (b-2) irradiating light from a second main surface side of the substrate, and rendering a latent image obtained by transferring a shape in plan view of the cavity in the photosensitive film; (b-3) removing the photosensitive film formed in a region in which a film of a lowermost layer forming the vibrator by development; (b-4) forming the film of the lowermost layer forming the vibrator in a region in which the photosensitive film is removed; and (b-5) removing the photosensitive film remaining outside the region in which the film of the lowermost layer forming the vibrator is formed.

According to the first invention, the width of the vibration plate can be made large, whereby a displacement amount of bending vibration can be increased, which increases a discharge amount of droplets. In addition, the unadhered region of the vibration plate which is likely to bend and the adhered region of the vibration plate which is contributory to application of an electric field to the piezoelectric/electrostrictive film, have sufficient areas, whereby the displacement amount of bending vibration can be increased, which increases the discharge amount of droplets. Further, the vibrator is not required to be pressed against the vibration plate, with the result that the vibration plate is unsusceptible to damage even when the vibration plate is made thinner.

According to the second invention, a step which causes bubbles can be eliminated, and thus it is possible to suppress bubbles from occurring inside the cavity.

According to the third invention, it is possible to increase the discharge amount of droplets while suppressing interference between adjacent unit structures.

According to the fourth invention, the substrate includes no interface between materials of difference types, whereby refraction or scattering of light can be suppressed at the interface. Accordingly, it is possible to stably obtain light required for patterning in a case where the substrate is used as a mask.

According to the fifth invention, it is possible to sufficiently obtain light required for patterning in the case where the substrate is used as a mask.

According to the sixth invention, a flow of a liquid from the first liquid flow path side to the second liquid flow path side is impeded, and hence it is possible to suppress the liquid from being ejected from the second flow path when the vibration plate is subjected to bending vibration to press the liquid filled in the cavity, which increases the discharge amount of droplets from the first flow path. In addition, the unadhered region of the vibration plate which is likely to bend and the adhered region of the vibration plate, which is contributory to application of an electric field the piezoelectric/electrostrictive film, have sufficient areas, whereby the displacement amount of bending vibration can be increased, which increases the discharge amount of droplets. Further, the vibrator is not required to be pressed against the vibration plate, with the result that the vibration plate is unsusceptible to damage even when the vibration plate is made thinner.

According to the seventh invention, a step which causes bubbles can be eliminated, and thus it is possible to suppress bubbles from occurring inside the cavity.

According to the eighth invention, the substrate includes no interface between materials of difference types, whereby refraction or scattering of light can be suppressed at the interface. Accordingly, it is possible to stably obtain light required for patterning in a case where the substrate is used as a mask.

According to the ninth invention, it is possible to sufficiently obtain light required for patterning in the case where the substrate is used as a mask.

According to the tenth invention, a flow of a liquid from the first liquid flow path side toward the second liquid flow path side is impeded, and hence it is possible to suppress the liquid from being ejected from the second flow path when the vibration plate is subjected to bending vibration to press the liquid filled in the cavity, which increases the discharge amount of droplets from the first flow path. In addition, in a case where a substrate of a ceramic sintered body is manufactured after the step of press-fitting a die having a three-dimensional shape corresponding to a three-dimensional shape of a cavity to a main surface of a ceramic green sheet, it is possible to suppress undulations of the second main surface of the substrate, which result from a density difference of the green sheet after the die is press-fitted. Further, the unadhered region of the vibration plate which is likely to bend and the fixed region of the vibration plate which is contributory to application of an electric field to the piezoelectric/electrostrictive film, have sufficient areas, whereby the displacement amount of bending vibration can be increased, which increases the discharge amount of droplets. In addition, the vibrator is not required to be pressed against the vibration plate, with the result that the vibration plate is unsusceptible to damage even when the vibration plate is made thinner.

According to the eleventh invention, a step which causes bubbles can be reduced, and thus it is possible to suppress bubbles from occurring inside the cavity.

According to the twelfth invention, the substrate includes no interface between materials of difference types, whereby refraction or scattering of light can be suppressed at the interface. Accordingly, it is possible to stably obtain light required for patterning in a case where the substrate is used as a mask.

According to the thirteenth invention, it is possible to sufficiently obtain light required for patterning in the case where the substrate is used as a mask.

According to the fourteenth invention, limitations of the three-dimensional shape of the cavity become less, whereby it is possible to form a cavity having a three-dimensional shape capable of increasing a discharge amount of droplets.

According to the fifteenth invention, the depth of the cavity can be increased, and thus a discharge amount of droplets can be increased.

According to the sixteenth invention, only the ceramic layer can be softened without considerably softening the first ceramic green sheet due to heating during thermocompression bonding, whereby it is possible to suppress the first ceramic green sheet from deforming due to application of pressure during thermocompression bonding, which improves dimension accuracy of the substrate.

According to the seventeenth invention, it is possible to prevent the through hole from becoming narrow or being blocked when the die is press-fitted to the first ceramic green sheet.

According to the eighteenth invention, the film of the lowermost layer is not formed in a peripheral portion of a vibration region, in which transmittance of light is close to that in a outside portion of vibration region, whereby it is possible to prevent the vibrator from coming out of the vibration region and causing a decrease in displacement amount of bending vibration.

These and other objects, features, aspects and advantages of the present invention will become more apparent from the following detailed description of the present invention when taken in conjunction with the accompanying drawings.

BRIEF DESCRIPTION OF DRAWINGS

FIG. 44 is a figure showing a change in discharge amount of droplets depending on a shape in longitudinal cross section of a cavity.

BEST MODE FOR CARRYING OUT THE INVENTION

1 First Embodiment

1-1 Configuration of droplet discharge device 1

Figure 1:
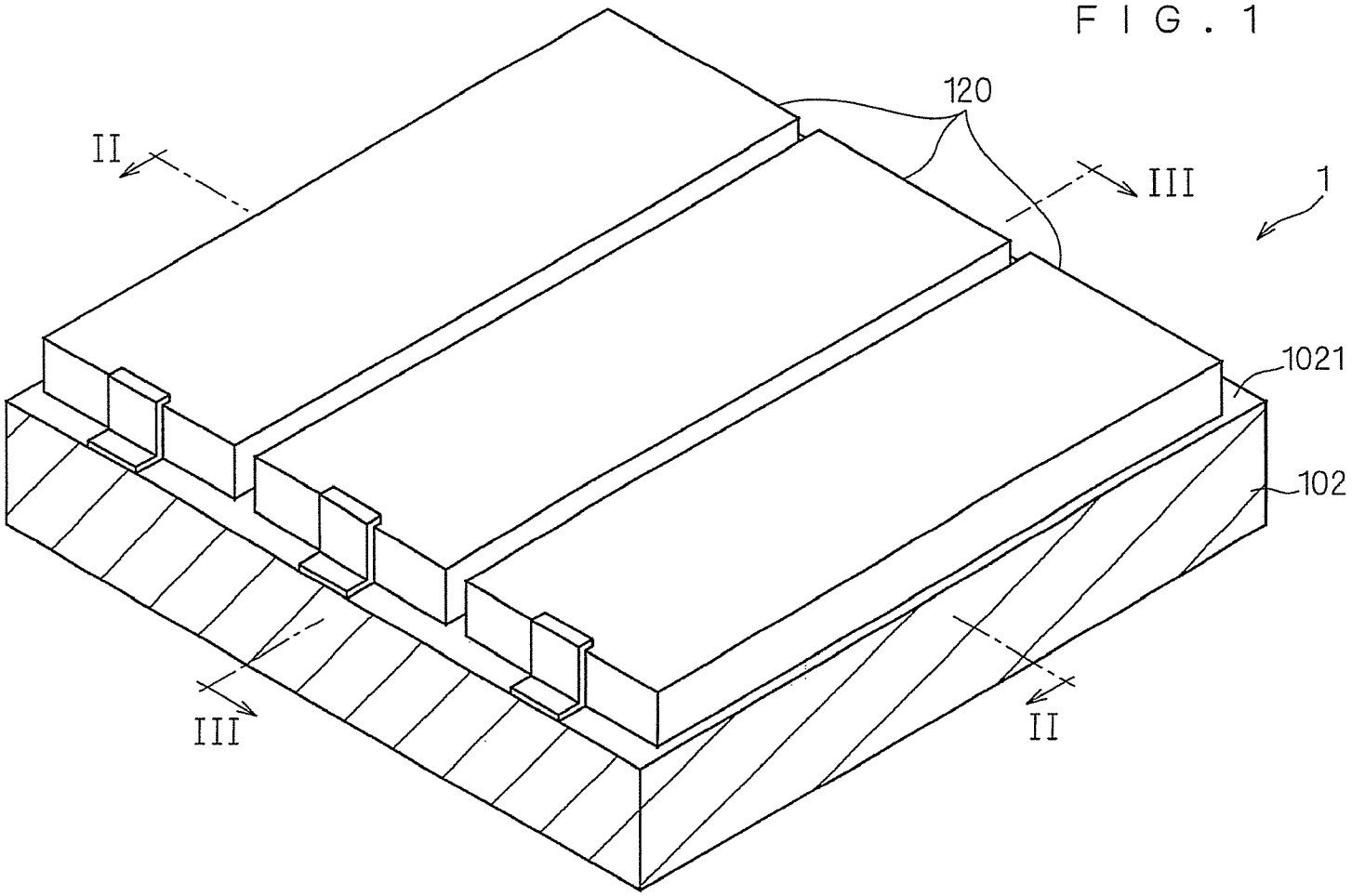
FIG. 1 is a perspective view of a droplet discharge device according to a first embodiment.
Figure 2:
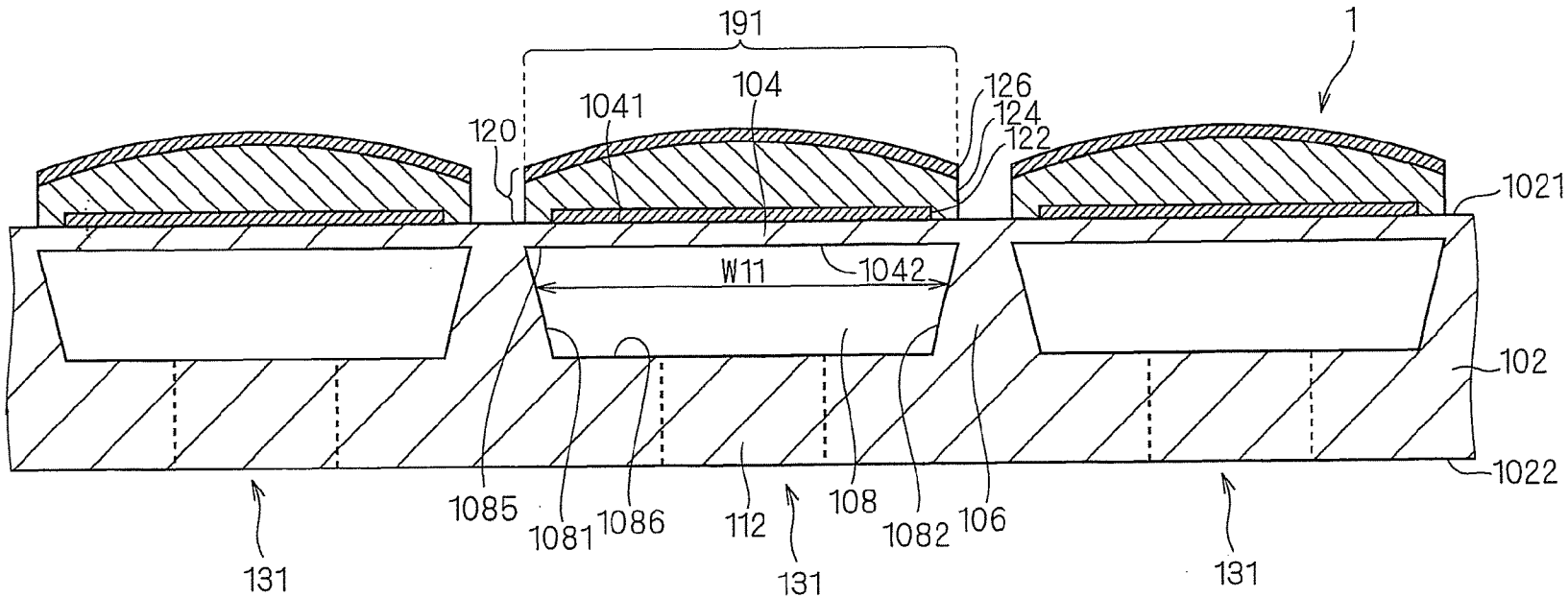
FIG. 2 is a cross-sectional view of the droplet discharge device, which is taken along II-II of FIG. 1.
Figure 3:
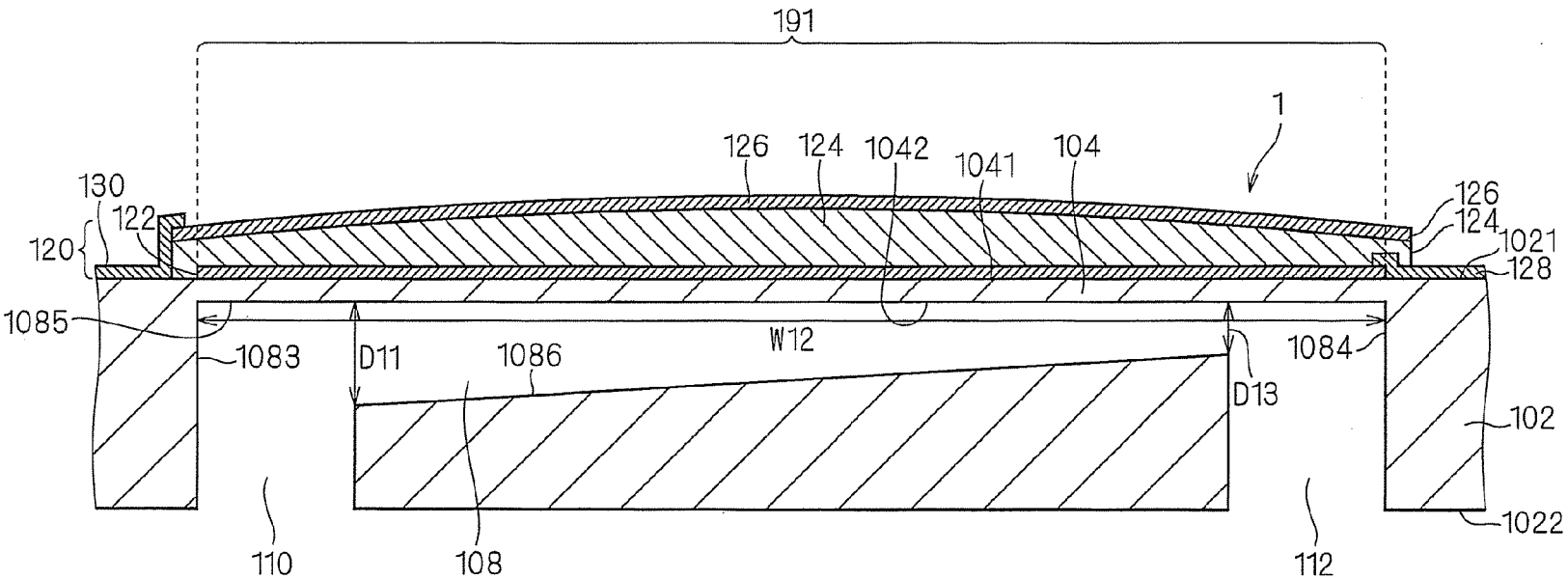
FIG. 3 is a cross-sectional view of the droplet discharge device, which is taken along of FIG. 1.

FIG. 1 to FIG. 3 are schematic views showing a configuration of a droplet discharge device 1 according to a first embodiment of the present invention. FIG. 1 is a perspective view of the droplet discharge device 1, FIG. 2 is a lateral cross-sectional view of the droplet discharge device 1, which is taken along II-II of FIG. 1, and FIG. 3 is a longitudinal cross-sectional view of the droplet discharge device 1, which is taken along of FIG. 1. The droplet discharge device 1 is a droplet discharge device for ink discharge, which is used in a head of an inkjet printer. Note that this fact does not prevent the configuration of the droplet discharge device 1 and a manufacturing method therefor, which will be described below, from being applied to other type of drop discharge device.

As shown in FIG. 1 to FIG. 3, the droplet discharge device 1 has a structure in which a plurality of vibrators 120 are arranged in a regular manner on an upper surface 1021 of a substrate 102. An arrangement interval between the vibrators 120 is not limited, and is typically from 70 to 212 μm.

1-2 Configuration of Substrate 102

The substrate 102 is a sintered body of insulating ceramic. A type of insulating ceramic is not limited, and in terms of heating resistance, chemical stability and insulation properties, it is desirable to include at least one type selected from a group consisting of zirconium oxide, aluminum oxide, magnesium oxide, mullite, aluminum oxide and silicon nitride. Among those, in terms of mechanical strength and tenacity, stabilized zirconium oxide is desirable. The "stabilized zirconium oxide" herein refers to zirconium oxide in which phase transition of crystals is suppressed by addition of a stabilizer, and includes partially stabilized zirconium oxide in addition to stabilized zirconium oxide.

As shown in FIG. 2 and FIG. 3, the substrate 102 has a structure in which cavities 108 which are voids and discharge holes 110 and supply holes 112 which serve as a liquid flow path are formed inside a plate including the upper surface 1021 and a lower surface 1022 which are substantially flat. The cavities 108 having an elongated rectangular shape in plan view are separated from the upper surface 1021 of the substrate 102 by a vibration plate 104 having an elongated rectangular shape in plan view. With such a structure, when the vibration plate 104 is subjected to bending vibration by the vibrators 120 which are fixedly installed on an upper surface 1041 of the vibration plate 104, liquids filled in the cavities 108 are pressed, whereby droplets are discharged from the discharge holes 110. Note that the number of discharge holes 110 may be two or more, and the number of supply holes 112 may be two or more. In addition, the shapes in plan view of the cavity 108 and the vibration plate 104 may be something other than a rectangle, and an apex thereof may be rounded.

As shown in FIG. 2, the droplet discharge device 1 is configured by arranging unit structures 131 each including the cavity 108, the discharge hole 110 and the supply hole 112. An arrangement direction of the unit structures 131 coincides with a short side direction of the vibration plate 104 and the cavity 108.

As shown in FIG. 2, a shape in lateral cross section of the cavity 108 is trapezoidal, and inner side surfaces 1081 and 1082 in the short side direction of the cavity 108 are inclined from a surface perpendicular to the upper surface 1021 of the substrate 102 along the short side direction of the cavity 108. The inner side surface 1081 and the inner side surface 1082 are relatively apart from each other on the upper surface 1021 side of the substrate 102, and are relatively close to each other on the lower surface 1022 side of the substrate 102. Accordingly, a lateral width W11 which is the dimension in the short side direction of the cavity 108, which is parallel to the upper surface 1021 of the substrate 102, becomes narrower from the upper surface 1021 side of the substrate 102 toward the lower surface 1022 side of the substrate 102. The cavity 108 is tapered from the upper surface 1021 side of the substrate 102 toward the lower surface 1022 side of the substrate 102 in this manner, whereby a lateral width of the vibration plate 104 can be made larger while maintaining strength of a frame 106 between the adjacent cavities 108. Accordingly, it is possible to increase a displacement amount of bending vibration while suppressing interference between the adjacent unit structures, with the result that a discharge amount of droplets can be increased.

Figure 4:
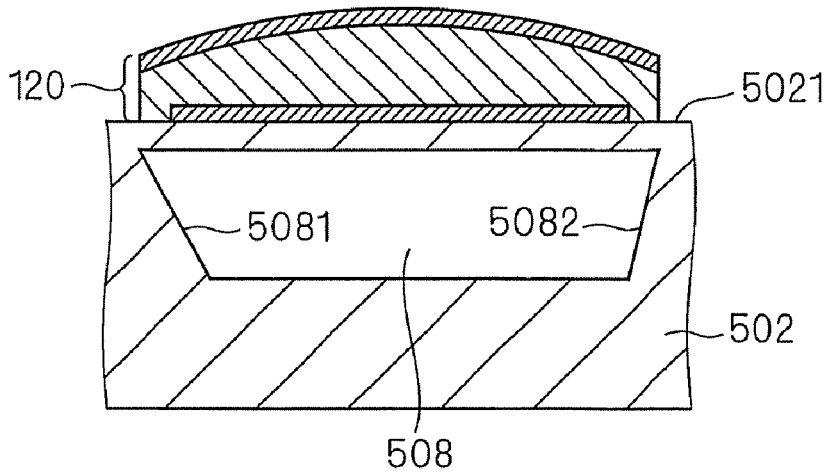
FIG. 4 is a cross-sectional view showing another example of a cavity.

Note that the inner side surface 1081 and the inner side surface 1082 are not necessarily required to be symmetric with respect to the surface perpendicular to the upper surface 1021 of the substrate 102. In place of the cavity 108, there may be used a cavity 508 including inner side surfaces 5081 and 5082 which are not symmetric with respect to a surface perpendicular to an upper surface 5021 of a substrate 502, as shown in a cross-sectional view of FIG. 4.

Meanwhile, as shown in FIG. 3, a shape in longitudinal cross section of the cavity 108 is also trapezoidal, and inner side surfaces 1083 and 1084 in a long side direction of the cavity 108 are perpendicular to the upper surface 1021 of the substrate 102. Therefore, a longitudinal width W12 being the dimension in the long side direction of the cavity 108, which is parallel to the upper surface 1021 of the substrate 102, is uniform.

Further, as shown in FIG. 3, an upper inner surface 1085 of the cavity 108, that is, a lower surface 1042 of the vibration plate 104 is parallel to the upper surface 1021 of the substrate 102. In addition, a lower inner surface 1086 of the cavity 108 is inclined from a surface parallel to the upper surface 1021 of the substrate 102 along the long side direction of the cavity 108. Accordingly, depths D11 and D13 which are the dimensions of the cavity 108 in a direction perpendicular to the upper surface 1021 of the substrate 102 become deeper from the supply hole 112 side toward the discharge hole 110 side if D11>D13 (in a case where D11=D13, the same shape in longitudinal cross section as that of FIG. 47). The cavity 108 is tapered from the discharge hole 110 side toward the supply hole 112 side in this manner, and thus a flow of a liquid from the discharge hole 110 side toward the supply hole 112 side is impeded. Accordingly, it is possible to suppress the liquid from being discharged from the supply hole 112 when the vibration plate 104 is subjected to bending vibration and the liquid filled in the cavity 108 is pressed, whereby the discharge amount of droplets from the discharge hole 110 can be increased.

The inner side surfaces 1081 to 1084, the upper inner surface 1085 and the lower inner surface 1086 of the cavity 108 are flat surfaces without steps. For this reason, the lateral width W11 of the cavity 108 becomes narrower in a continuous manner from the upper surface 1021 side of the substrate 102 toward the lower surface 1022 side of the substrate 102, and the depths D11 and D13 of the cavity 108 become deeper in a continuous manner from the supply hole 112 side toward the discharge hole 110 side if D11>D13 (in a case where D11=D13, the same shape in longitudinal cross section as that of FIG. 47). The steps which cause babbles are removed from the inner side surfaces 1081 to 1084, the upper inner surface 1085 and the lower inner surface 1086 of the cavity 108 in this manner, whereby it is possible to suppress bubbles from occurring inside the cavity 108. Note that it is most desirable to remove steps from all of the inner side surfaces 1081 to 1084, the upper inner surface 1085 and the lower inner surface 1086. However, an effect of suppressing bubbles can be obtained to a certain degree even when steps are removed from part of the inner side surfaces 1081 to 1084, the upper inner surface 1085 and the lower inner surface 1086.

The discharge hole 110 is a flow path of a liquid, which extends from the cavity 108 to an outside of the substrate 102. The discharge hole 110 is a circular hole piercing from a vicinity of one end in the long side direction of the lower inner surface 1086 of the cavity 108 to the lower surface 1022 of the substrate 102, perpendicularly to the upper surface 1021 of the substrate 102. The supply hole 112 is a flow path of a liquid, which extends from the outside of the substrate 102 to the cavity 108. The supply hole 112 is a circular hole piercing from a vicinity of the other end in the long side direction of the lower inner surface 1086 of the cavity 108 to the lower surface 1022 of the substrate 102, perpendicularly to the upper surface 1021 of the substrate 102. Note that a discharge port of the discharge hole 110 and a supply port of the supply hole 112 are not necessarily required to be provided on the lower surface 1022 of the substrate 102, and may be provided at other positions of an outer surface of the substrate 102. Alternatively, the discharge hole 110 and the supply hole 112 are not necessarily required to be straight and may be curved. Still alternatively, hole diameters of the discharge hole 110 and the supply hole 112 are not necessarily required to be uniform and may be tapered in a continuous or discontinuous manner.

The vibration plate 104 is a plate including the upper surface 1041 and the lower surface 1042 which are substantially flat. Note that the upper surface 1041 and the lower surface 1042 of the vibration plate 104 are not necessarily required to be substantially flat, and may be slightly concave/convex or curved. A plate thickness of the vibration plate 104 is desirably from 0.5 to 5 μm. This is because the vibration plate 104 is susceptible to damage if the plate thickness falls below this range, while if plate thickness exceeds this range, rigidity of the vibration plate 104 increases, whereby the displacement amount of bending vibration tends to decrease. There are no limitations on a lateral width which is a dimension in the short side direction of the vibration plate 104 and a longitudinal width which is a dimension in the long side direction thereof. The lateral width is desirably from 0.06 to 0.2 mm, and the longitudinal width is desirably from 0.3 to 2.0 mm.

1-3 Configuration of Vibrator 120

The vibrator 120 has a structure in which a lower electrode film 122, a piezoelectric/electrostrictive film 124 and an upper electrode film 126 extending in parallel to the upper surface 1021 of the substrate 102 are laminated in the stated order from bottom to top. Note that, in place of the single-layer vibrator 120 including single layer of a piezoelectric/electrostrictive film 124, there may be used a multi-layer vibrator which includes two or more piezoelectric/electrostrictive films and has a structure in which the piezoelectric/electrostrictive films and the electrode films are laminated alternately. In this case, all of the piezoelectric/electrostrictive films forming the vibrator is not necessarily required to be an active layer to which an electric field is applied, and part of the piezoelectric/electrostrictive films forming the vibrator (typically, lowermost layer or uppermost layer of the piezoelectric/electrostrictive film) may be an inactive layer to which the electric field is not applied.

(Lower Electrode Film 122 and Upper Electrode Film 126)

The lower electrode film 122 and the upper electrode film 126 are films of a sintered body of a conductive material. A type of the conductive material is not limited, and in terms of electric resistance and heat resistance, it is desirably metal such as platinum, palladium, rhodium, gold, silver and the like or an alloy containing those as main components. Of those, platinum or an alloy containing platinum as a main component particularly excellent in heat resistance is desirable.

Film thicknesses of the lower electrode film 122 and the upper electrode film 126 are desirably from 0.5 to 3 μm. This is because rigidity of the lower electrode film 122 and that of the upper electrode film 126 tend to increase to decrease the displacement amount of bending vibration if the film thicknesses exceed this range, while electric resistances of the lower electrode film 122 and the upper electrode film 126 tend to increase if the film thicknesses fall below this range.

(Piezoelectric/Electrostrictive Film 124)

The piezoelectric/electrostrictive film 124 is a film of a sintered body of piezoelectric/electrostrictive ceramic. A type of the piezoelectric/electrostrictive ceramic is not limited, and in terms of a volume of electric-field-induced strain, it is desirably a lead (Pb)-based perovskite oxide, and more desirably, is lead zirconate titanate (PZT; $Pb(Zr_XTi_{1-X})O_3$) or modified lead zirconate titanate to which a simple oxide, complex oxide or the like is introduced. Of those, a resultant obtained by introducing a nickel oxide (NiO) to a solid solution of lead zirconate titanate and lead magnesium niobate ($Pb(Mg_{1/3}Nb_{2/3})O_3$) or a solid solution of lead zirconate titanate and lead nickel niobate ($Pb(Ni_{1/3}Nb_{2/3})O_3$).

The piezoelectric/electrostrictive film 124 desirably has a film thickness of 1 to 10 μm. This is because the piezoelectric/electrostrictive film 124 tends to be insufficiently dense if the film thickness falls below this range, while if the film thickness exceeds this range, shrinkage stress of the piezoelectric/electrostrictive film 124 in sintering becomes large, which results in a need for increasing the plate thickness of the vibration plate 104.

(Lower Wiring Electrode 128 and Upper Wiring Electrode 130)

The vibrator 120 includes a lower wiring electrode 128 which serves as a feeding path to the lower electrode film 122 and an upper wiring electrode 130 which serves as a feeding path to the upper electrode film 126. One end of the lower wiring electrode 128 is positioned between the lower electrode film 122 and the piezoelectric/electrostrictive film 124 and is in electrical conduction with one end of the lower electrode film 122, and the other end of the lower wiring electrode 128 is positioned outside a vibration region 191 in which the vibration plate 104 which is subjected to bending vibration is provided. On end of the upper wiring electrode 130 is positioned on the upper electrode film 126 and is in electrical conduction with one end of the upper electrode film 126, and the other end of the upper electrode film 126 is also positioned outside the vibration region 191.

The lower wiring electrode 128 and the upper wiring electrode 130 are provided so that a driving signal is fed to feeding points of the lower wiring electrode 128 and the upper wiring electrode 130, which are positioned outside the vibration region 191, with the result that an electric field can be applied to the piezoelectric/electrostrictive film 124 without affecting bending vibration.

(Driving of Vibrator 120)

The vibrators 120 are integrated with the vibration plate 104 above the cavities 108. With such a structure, a driving signal is fed, via the lower wiring electrode 128 and the upper wiring electrode 130, between the lower electrode film 122 and the upper electrode film 126 which are opposed to each other with the piezoelectric/electrostrictive film 124 being sandwiched therebetween. Then, an electric field is applied to the piezoelectric/electrostrictive film 124, whereby the piezoelectric/electrostrictive film 124 expands and contracts in a direction parallel to the upper surface 1021 of the substrate 102, and the integrated vibrators 120 and the vibration plate 104 are subjected to bending vibration. Through this bending vibration, liquids filled in the cavities 108 are discharged from the discharge holes 110.

1-4 Method of Manufacturing Droplet Discharge Device 1

Figure 5:
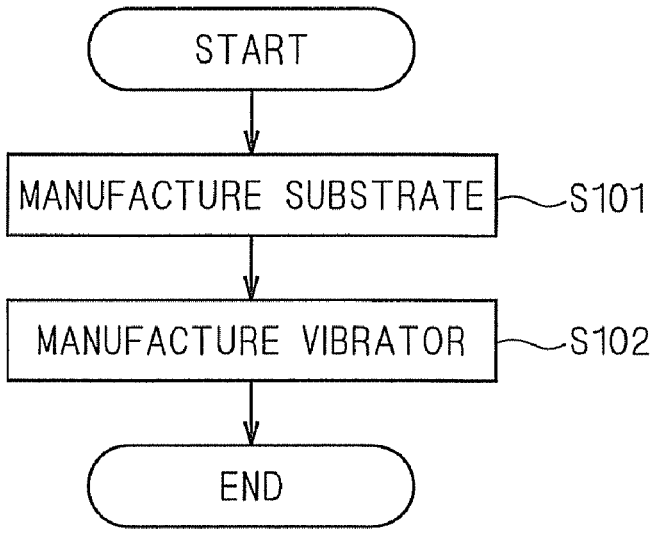
FIG. 5 is a flowchart describing a method of manufacturing the droplet discharge device according to the first embodiment.

FIG. 5 is a flowchart describing a method of manufacturing the droplet discharge device 1 according to the first embodiment of the present invention. As shown in FIG. 5, the droplet discharge device 1 is manufactured by manufacturing the substrate 102 (Step S101), and then manufacturing the vibrators 120 on the upper surface 1021 of the manufactured substrate 102 (Step S102).

1-5 Method of Manufacturing Substrate 102

Figure 6:
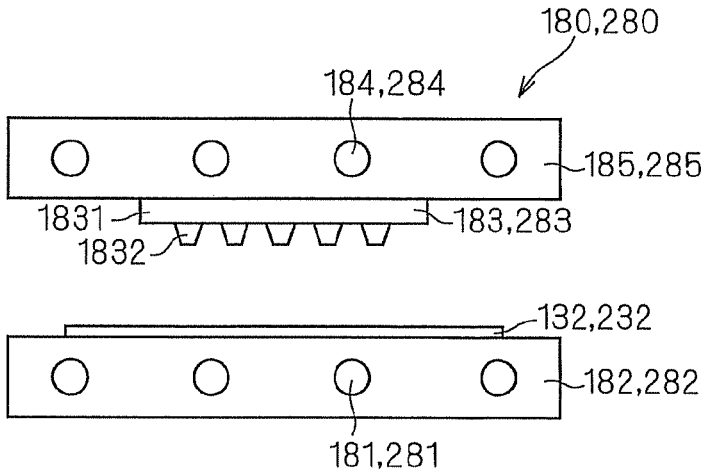
FIG. 6 is a cross-sectional view of a forming machine used in manufacturing a substrate according to the first embodiment.
Figure 7:
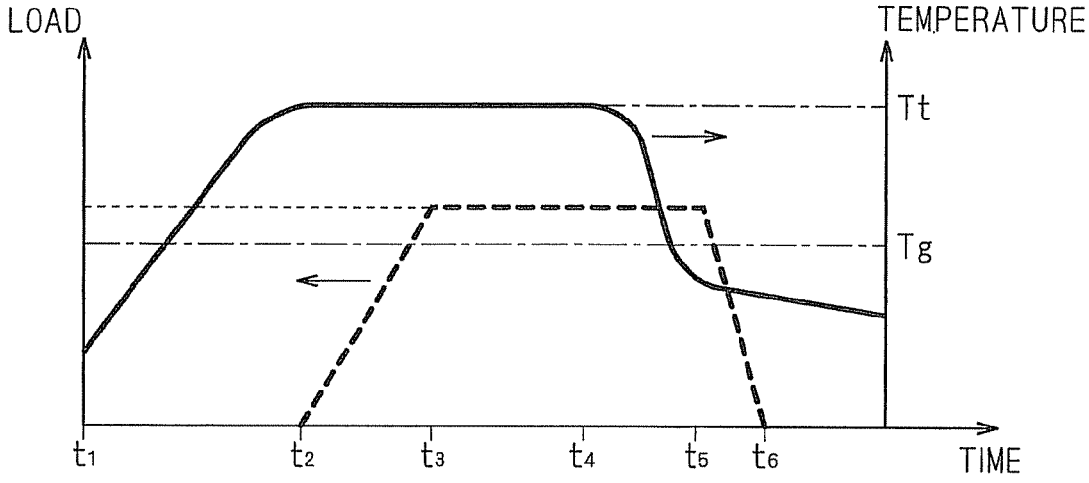
FIG. 7 is a graph showing changes over time in temperature of a green sheet and in load applied to a die during forming.

FIG. 6 is a schematic view of a forming machine 180 which is used in manufacturing the substrate 102 according to the first embodiment. FIG. 6 is a cross-sectional view of the forming machine 180. FIG. 7 is a figure showing changes over time in temperature of an insulating ceramic green sheet (hereinafter, referred to as "green sheet") 132 obtained by forming a powder of insulating ceramic into a sheet form and in load applied to a die 183. In addition, FIG. 8 to FIG. 11 are schematic views describing a method of manufacturing the substrate 102 according to the first embodiment. FIG. 8 to FIG. 11 are cross-sectional views of the substrate 102 in the course of manufacture.

(Forming Machine)

As shown in FIG. 6, the forming machine 180 includes the die 183 which forms the green sheet 132, a hot plate 182 which sucks the green sheet 132 in vacuum to be fixed and heats the green sheet 132, and a hot plate 185 which supports the die 183 from thereabove and heats the die 183. The hot plates 182 and 185 contain heaters 181 and 184 for heating, respectively.

The die 183 has a three-dimensional shape corresponding to a three-dimensional shape of the cavity 108. The die 183 has a three-dimensional shape such that a desired three-dimensional shape of the cavity 108 can be obtained in the end in consideration of deformation in thermo-compression bonding, shrinkage in firing and the like. The die 183 has a structure in which press-fitting portions 1832 having a trapezoidal shape in lateral cross section where a width of a tip thereof is smaller than a width of a bottom thereof are provided on a lower surface of a base portion 1831.

(Rise in Temperature of Green Sheet 132 (from Timing t1 to Timing t2))

In manufacturing the substrate 102, first, the green sheet 132 is placed on the hot plate 182 which has been heated by the heater 181 to be sucked in vacuum. As a result, the green sheet 132 is fixed to the hot plate 182, and thus a temperature of the green sheet 132 is raised to a glass transition temperature Tg or higher. The glass transition temperature Tg varies depending on, for example, a type of a binder used in the green sheet 132, and is typically several tens of degrees.

(Press-Fitting of Die 183 to Green Sheet 132 (from Timing t2 to Timing t3))

Figure 8:
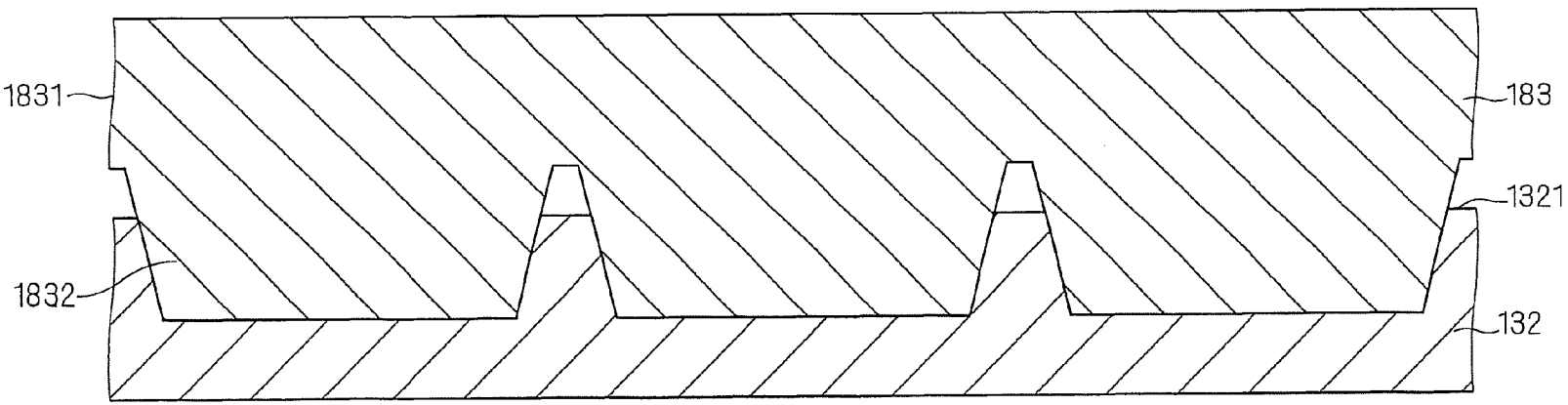
FIG. 8 is a cross-sectional view describing a method of manufacturing the substrate according to the first embodiment.

The temperature of the green sheet 132 is raised to the glass transition temperature Tg or higher, and then load is applied to the die 183 so that the die 183 is press-fitted to the upper surface 1321 of the green sheet 132. It is desirable to continue heating of the hot plate 182 by the heater 181 during this period so that the temperature of the green sheet 132 is kept at a constant temperature Tt. Naturally, the temperature Tt is a temperature equal to or higher than the glass transition temperature Tg. In order to prevent the temperature of the green sheet 132 from decreasing due to press-fitting of the die 183, the die 183 is desirably heated in advance by the heater 184 before press-fitting. When the die 183 is press-fitted to the green sheet 132 which has been heated in this manner to become susceptible to plastic deformation, the green sheet 132 undergoes plastic deformation as shown in FIG. 8, whereby the three-dimensional shape of the die 183 is transferred onto the upper surface 1321 of the green sheet 132.

(Holding of State in which Die 183 is Press-Fitted (from Timing t3 to Timing t4))

Subsequently, a state in which the die 183 is press-fitted to the upper surface 1321 of the green sheet 132 is held. It is desirable to continue heating of the hot plate 182 by the heater 181 and hold the temperature of the green sheet 132 at the constant temperature Tt during this period.

(Decrease in Temperature of Green Sheet 132 (from Timing t4 to Timing t5))

Subsequently, heating of the hot plate 182 by the heater 181 is stopped while keeping the state in which the die 183 is press-fitted to the upper surface 1321 of the green sheet 132, whereby the temperature of the green sheet 132 is decreased below the glass transition temperature Tg. Naturally, in a case where the die 183 is also heated, the heating of the die 183 is stopped as well.

(Separation Between Green Sheet 132 and Die 183 (from Timing t5 to Timing t6))

The temperature of the green sheet 132 is decreased below the glass transition temperature Tg, and then the green sheet 132 and the die 183 are separated from each other. In this case, the green sheet 132 has lost most of its elasticity, and thus spring back hardly occurs, whereby dents 134 which will later become the cavities 108 are formed on the upper surface 1321 of the green sheet 132.

(Formation of Through Hole 136)

Figure 9:
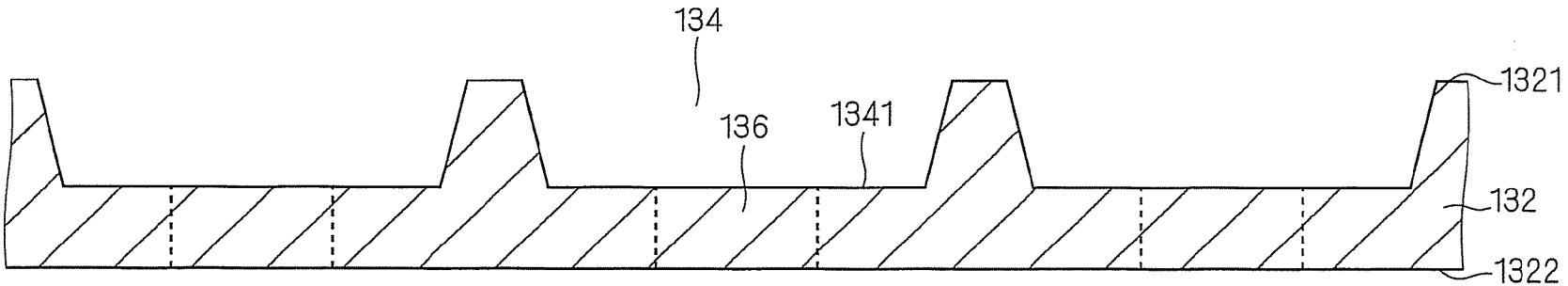
FIG. 9 is a cross-sectional view describing the method of manufacturing the substrate according to the first embodiment.

Subsequently, as shown in FIG. 9, through holes 136 each penetrating from an inner lower surface 1341 of the dent 134 to a lower surface 1322 of the green sheet 132 are formed in the green sheet 132. The through holes 136 may be formed by punching process with a die, or may be formed by drilling processing with a laser beam. Note that, if the through holes 136 are formed after the formation of the dents 134, it is possible to prevent the through holes 136 from being constricted or blocked when the die 183 is press-fitted to the green sheet 132. Note that this fact does not prevent the dents from being formed after the formation of the through holes each penetrating from the upper surface 1321 to the lower surface 1322 of the green sheet 132.

(Thermocompression-Bonding of Green Sheets 138 and 140)

Figure 10:
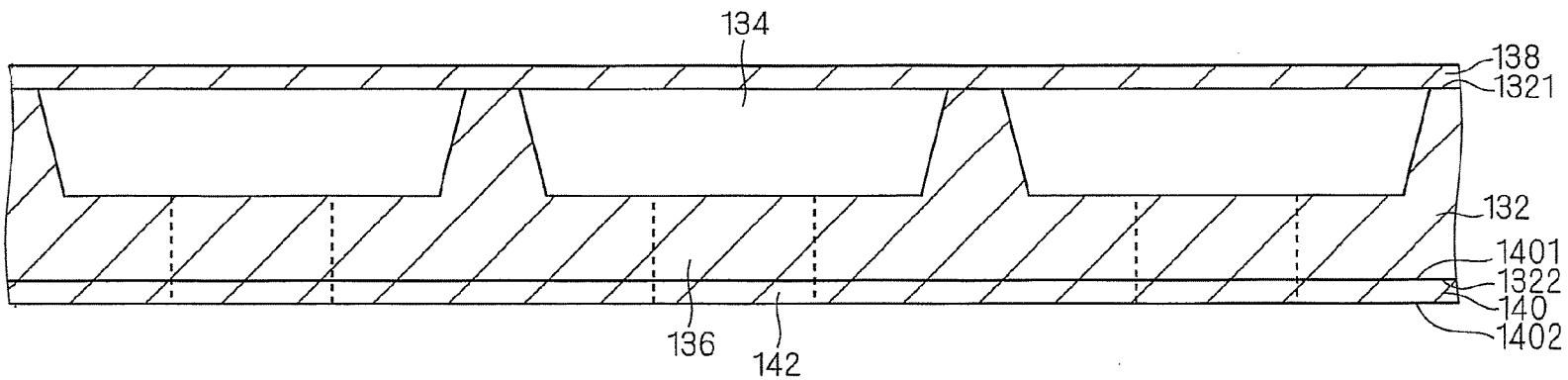
FIG. 10 is a cross-sectional view describing the method of manufacturing the substrate according to the first embodiment.

Subsequently, as shown in FIG. 10, a green sheet 138 and a green sheet 140 are thermocompression-bonded to the upper surface 1321 of the green sheet 132 and the lower surface 1322 of the green sheet 132, respectively. In the green sheet 140, through holes 142 each penetrating from an upper surface 1401 to an lower surface 1402 are formed at the same positions as the through holes 136. The green sheet 138 is thermocompression-bonded in this manner, whereby the dents 134 become voids inside a press-bonded body. Further, through thermocompression bonding of the green sheet 140, lengths of the discharge hole 110 and the supply hole 112 can be increased or the hole diameters of the discharge hole 110 and the supply hole 112 can be gradually changed. When it is not required, thermocompression bonding of the green sheet 140 may be omitted.

(Cofiring)

Figure 11:
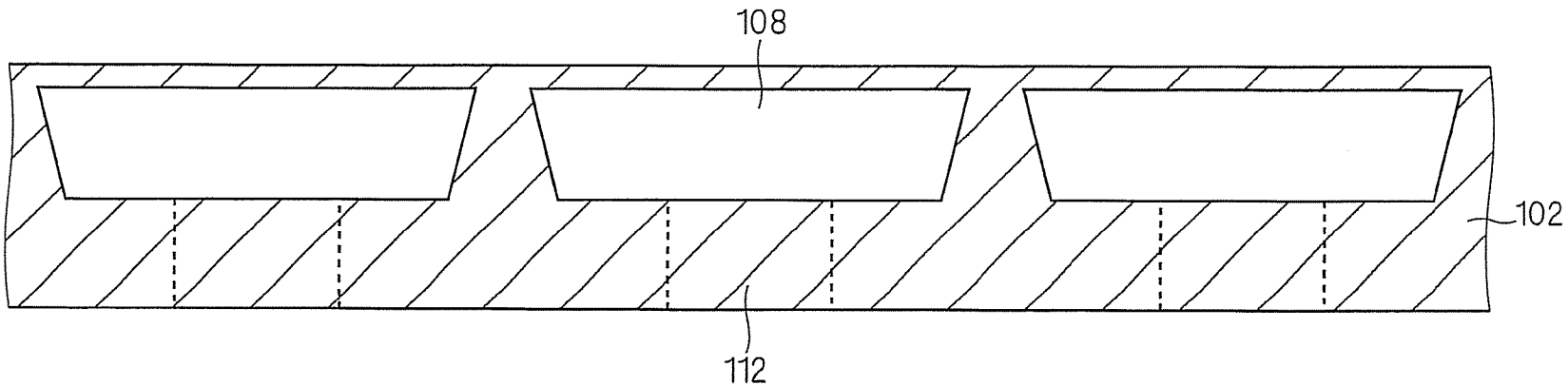
FIG. 11 is a cross-sectional view describing the method of manufacturing the substrate according to the first embodiment.

Subsequently, the green sheets 132, 138 and 140 are subjected to cofiring. Accordingly, the substrate 102 as shown in FIG. 11, which is integrated and has high rigidity, can be obtained.

The dents 134 which will later become the cavities 108 by imprint forming are formed in this manner, whereby limitations of the three-dimensional shape of the cavity 108 become less. Accordingly, it is possible to form the cavity 108 having a three-dimensional shape capable of increasing a discharge amount of droplets.

Note that the substrate 102 in which the cavities 108 having the above-mentioned three-dimensional shape are formed can be manufactured by a casting method of pouring slurry in which an insulating ceramic powder is dispersed in dispersion medium in a casting mold, or can be manufactured by an etching method of subjecting the substrate into etching process as in the case of manufacturing a semiconductor device. However, in contrast to the above-mentioned imprint method, the casting method and the etching method have the following problems.

That is, by the casting method, it is difficult to obtain a molded body having high molding density, and besides pressure cannot be applied to a portion other than the frame 106 when thermocompression bonding is performed. Accordingly, a porosity becomes higher in the portion other than the frame 106 of the substrate 102 obtained through firing, and thus the substrate 102 having high rigidity cannot be obtained.

Meanwhile, by the etching method, it is difficult to incline the lower inner surface 1086 of the cavity 108. Even though it is possible to incline the inner side surfaces 1081 and 1082 to slope, which is troublesome, and thus it is difficult to make the inner side surfaces 1081 and 1082 flat surfaces. Further, the vibration plate 104 is foamed by bonding, and hence the substrate 102 having high rigidity cannot be obtained.

(1-6 Method of Manufacturing Vibrator 120)

FIG. 12 to FIG. 21 are schematic views describing a method of manufacturing the vibrator 120 according to the first embodiment. FIG. 12 to FIG. 21 are cross-sectional views of the substrate 102 and the vibrators 120 in the course of the manufacture.

(Formation of Lower Electrode Film 122)

Figure 12:
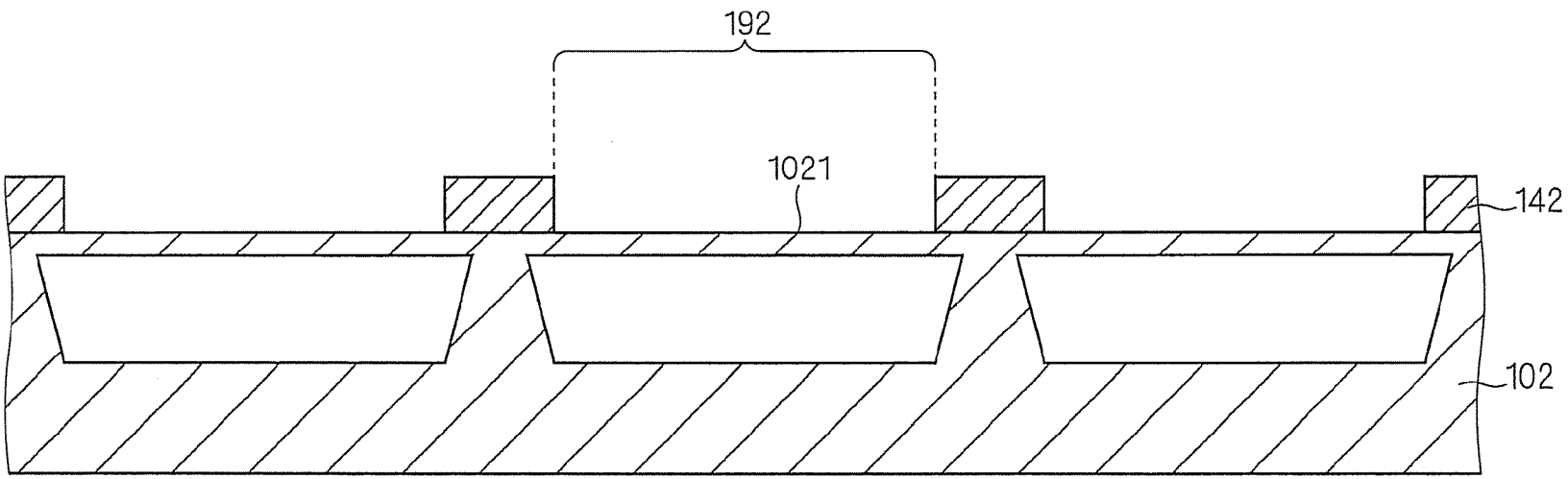
FIG. 12 is a cross-sectional view describing a method of manufacturing a vibrator according to the first embodiment.

In manufacturing the vibrator 120, first, as shown in FIG. 12, a resist pattern 142, which covers an outside of a region (hereinafter, referred to as "lower electrode film forming region") 192 in which the lower electrode film 122 is formed, is fanned on the upper surface 1021 of the substrate 102. The resist pattern 142 is formed by patterning a resist film 152 covering the upper surface 1021 of the substrate 102, which will be described below, by a photolithography method with the substrate 102 being as a photomask.

Figure 13:
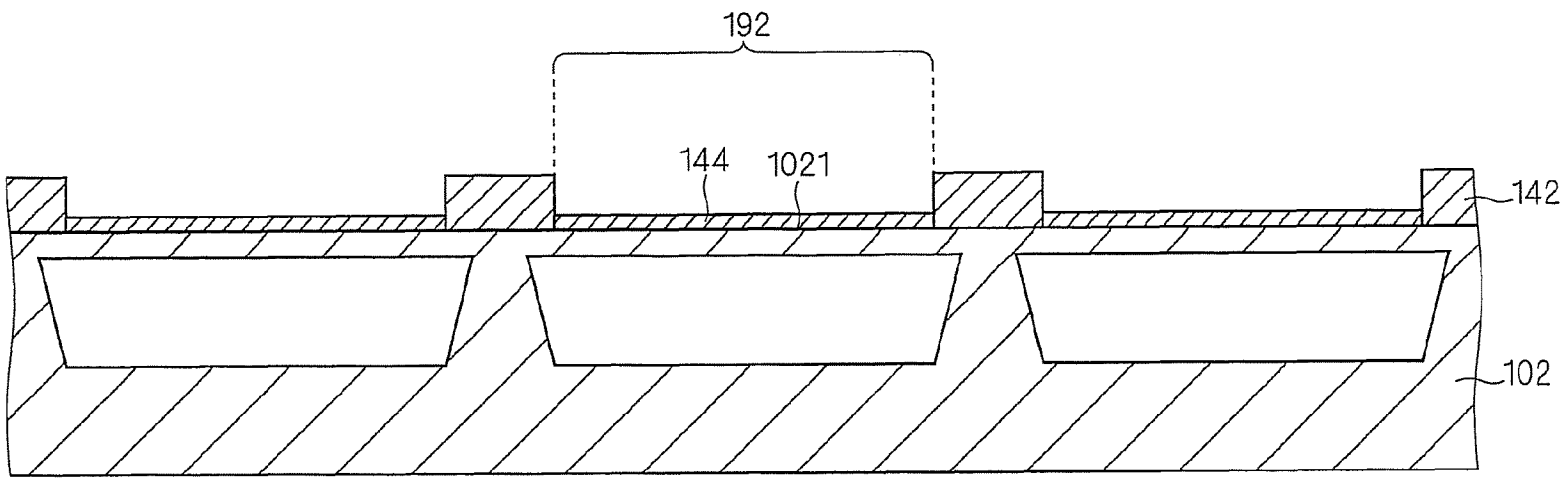
FIG. 13 is a cross-sectional view describing the method of manufacturing the vibrator according to the first embodiment.

After the formation of the resist pattern 142, as shown in FIG. 13, a conductive material film 144 which will later become the lower electrode film 122 is formed in the lower electrode film forming region 192 on the upper surface 1021 of the substrate 102. Note that the resist pattern 142 will be removed later, and thus there occurs no problem if the conductive material film 144 comes out of the lower electrode film forming region 192. The conductive material film 144 may be formed by applying a paste obtained by dispersing a conductive material in dispersion medium (hereinafter, referred to as "conductive paste") or a solution obtained by dissolving resinate of a conductive material in solvent (hereinafter, referred to as "conductive resinate solution"), and then removing the dispersion medium or the solvent. Alternatively, the conductive material film 144 may be formed by depositing a conductive material. The conductive paste can be applied by screen printing or the like, and the conductive resinate solution can be applied by spin coating, spraying or the like. The conductive material can be deposited by sputter deposition, resistance heating deposition or the like.

Figure 14:
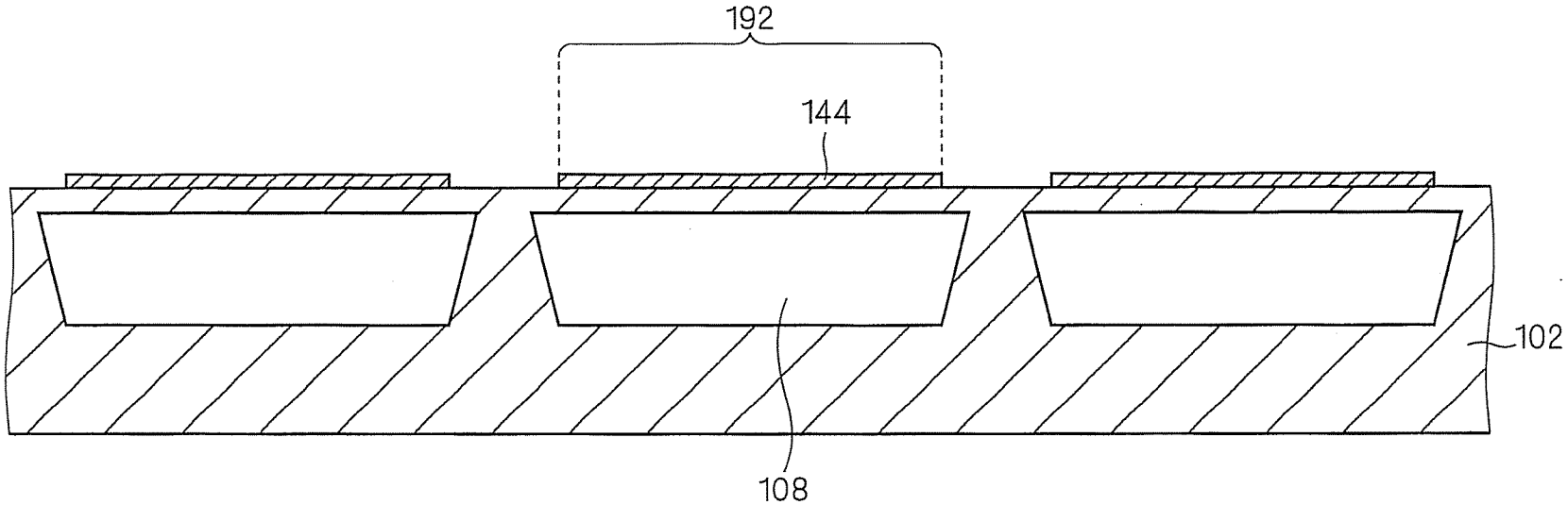
FIG. 14 is a cross-sectional view describing the method of manufacturing the vibrator according to the first embodiment.

After the formation of the conductive material film 144, as shown in FIG. 14, the resist pattern 142 remaining outside the lower electrode film forming region 192 is stripped and removed. As a result, the conductive material film 144 is formed at the same positions as those of the cavities 108 in plan view. The resist pattern 142 is stripped by a chemical solution method. Alternatively, the resist pattern 142 may be stripped by a heat treatment method, a plasma treatment method or the like, and in the case of the heat treatment method, a treatment temperature is desirably from 200 to 300° C.

Figure 15:
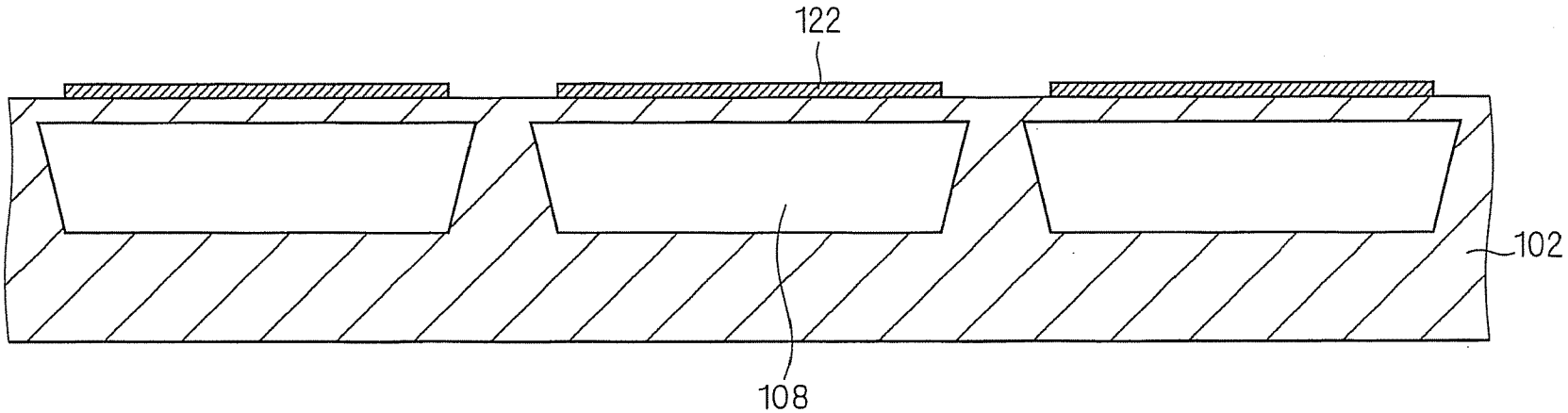
FIG. 15 is a cross-sectional view describing the method of manufacturing the vibrator according to the first embodiment.

The conductive material film 144 is subjected to firing after stripping the resist pattern 142. As a result, as shown in FIG. 15, the conductive material film 144 becomes the lower electrode film 122, and the lower electrode film 122 is formed at the same positions as those of the cavities 108 in plan view. The lower electrode film 122 is adhered to the upper surface 1041 of the vibration plate 104. The "adherence" herein refers to bonding the lower electrode film 122 and the vibration plate 104 by solid phase reaction (interdiffusion reaction) occurring at an interface between the lower electrode film 122 and the vibration plate 104 without using an adhesive. In bonding the lower electrode film 122 and the vibration plate 104 through the above-mentioned "adherence", the vibrators 120 are not required to be pressed against the vibration plate 104, which is advantageous in that the vibration plate 104 is unsusceptible to damage even if the vibration plate 104 becomes thinner. This fact is contributory to miniaturization of the droplet discharge device 1. In a case where the conductive material film 144 is foamed by subjecting a conductive paste obtained by dispersing nanoparticles of platinum in dispersion medium to screen printing, a firing temperature is desirably from 200 to 300° C. or less. In a case where a conductive material film is formed by subjecting a conductive paste obtained by dispersing powders of platinum in dispersion medium to screen printing, a firing temperature is desirably from 1,000° C. to 1,350° C. In a case where the conductive material film 144 is formed by subjecting a conductive resinate solution obtained by dissolving platinum resinate in a solvent to spin coating, a firing temperature is desirably from 600° C. to 800° C. or less.

(Formation of Lower Wiring Electrode 128)

Subsequently, the lower wiring electrode 128 is formed. The lower wiring electrode 128 may be formed by subjecting a conductive paste to screen printing and then to firing, or may be formed by depositing a conductive material.

(Formation of Piezoelectric/Electrostrictive Film 124)

Figure 16:
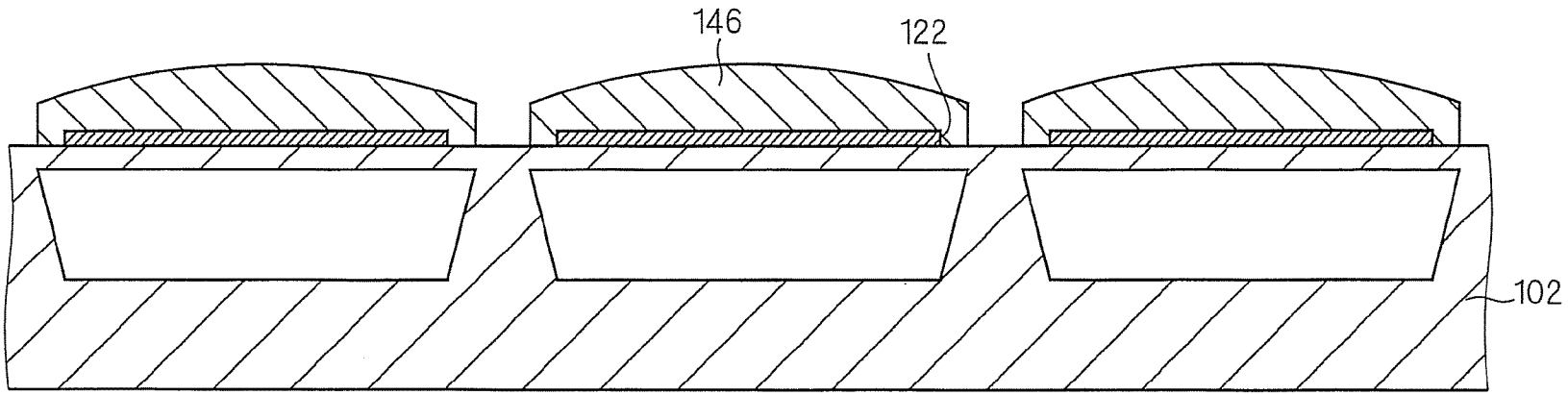
FIG. 16 is a cross-sectional view describing the method of manufacturing the vibrator according to the first embodiment.

Subsequently, as shown in FIG. 16, a piezoelectric/electrostrictive material film 146 which will later become the piezoelectric/electrostrictive film 124 is formed. The piezoelectric/electrostrictive material film 146 can be formed by immersing a product in process and a counter electrode at an interval in a slurry obtained by dispersing a piezoelectric/electrostrictive material in dispersion medium and by applying a voltage to the lower electrode film 122 and the counter electrode, to thereby subject the piezoelectric/electrostrictive material to electrophoresis toward the lower electrode film 122. As a result, the piezoelectric/electrostrictive material film 146 is formed at the same position as that of the lower electrode film 122 in plan view. Note that, in place of the piezoelectric/electrostrictive film 124 formed by electrophoresis, a piezoelectric/electrostrictive film, which is formed using a resist pattern formed by patterning a resist film covering the upper surface 1021 of the substrate 102 by a photolithography method with the lower electrode film 122 being as a photomask, may be used.

Figure 17:
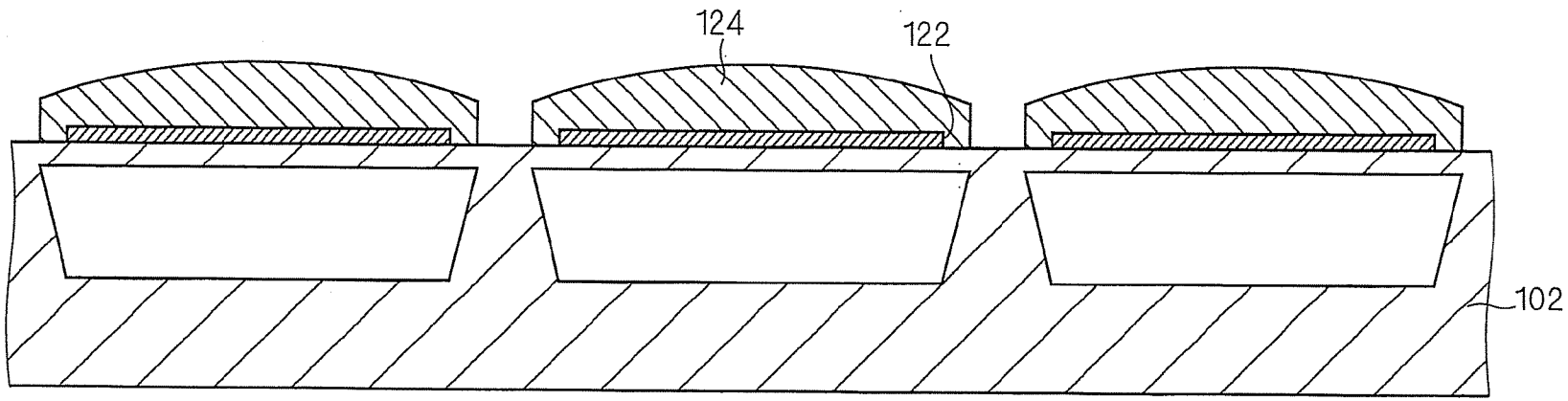
FIG. 17 is a cross-sectional view describing the method of manufacturing the vibrator according to the first embodiment.

The piezoelectric/electrostrictive material film 146 is subjected to firing after the formation of the piezoelectric/electrostrictive material film 146. As a result, as shown in FIG. 17, the piezoelectric/electrostrictive material film 146 becomes the piezoelectric/electrostrictive film 124, and the piezoelectric/electrostrictive film 124 is formed at the same position as that of the lower electrode film 122 in plan view. Firing of the piezoelectric/electrostrictive material film 146 is desirably performed in a state where a product in process is accommodated in a sagger of alumina, magnesia or the like.

(Formation of Upper Electrode Film 126)

Figure 18:
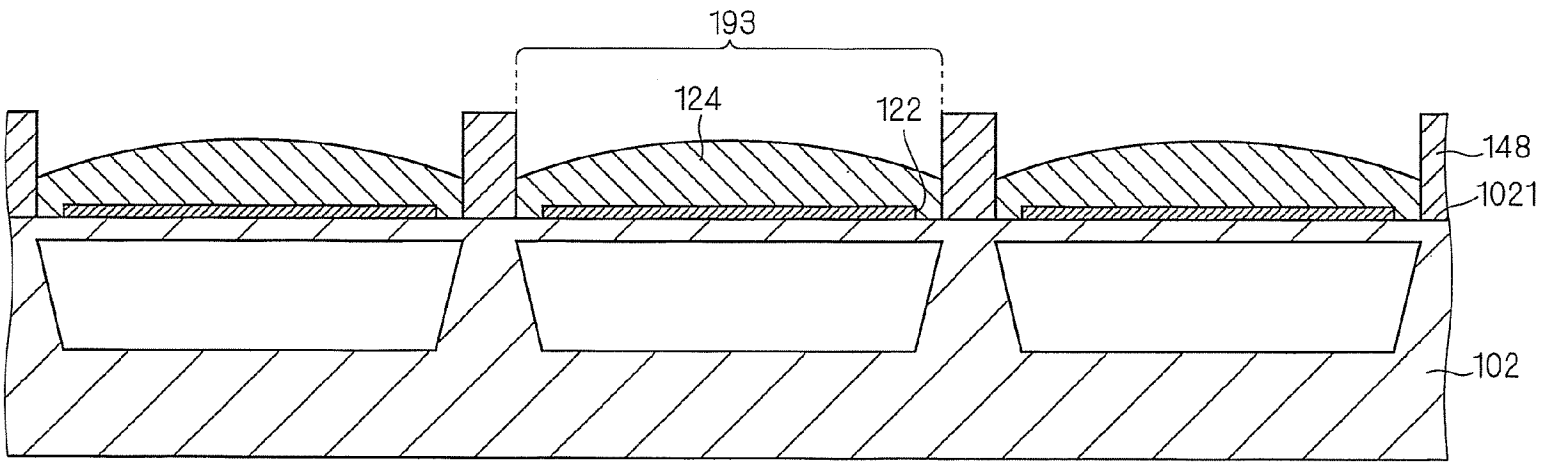
FIG. 18 is a cross-sectional view describing the method of manufacturing the vibrator according to the first embodiment.

After the firing of the piezoelectric/electrostrictive material film 146, as shown in FIG. 18, a resist pattern 148 covering an outside of a region (hereinafter, referred to as "piezoelectric/electrostrictive film forming region") 193 in which the piezoelectric/electrostrictive film 124 is formed is formed on the upper surface 1021 of the substrate 102. The resist pattern 142 is formed by patterning a resist film 160 covering the upper surface 1021 of the substrate 102, which will be described below, by the photolithography method with the piezoelectric/electrostrictive film 124 being as a photomask.

Figure 19:
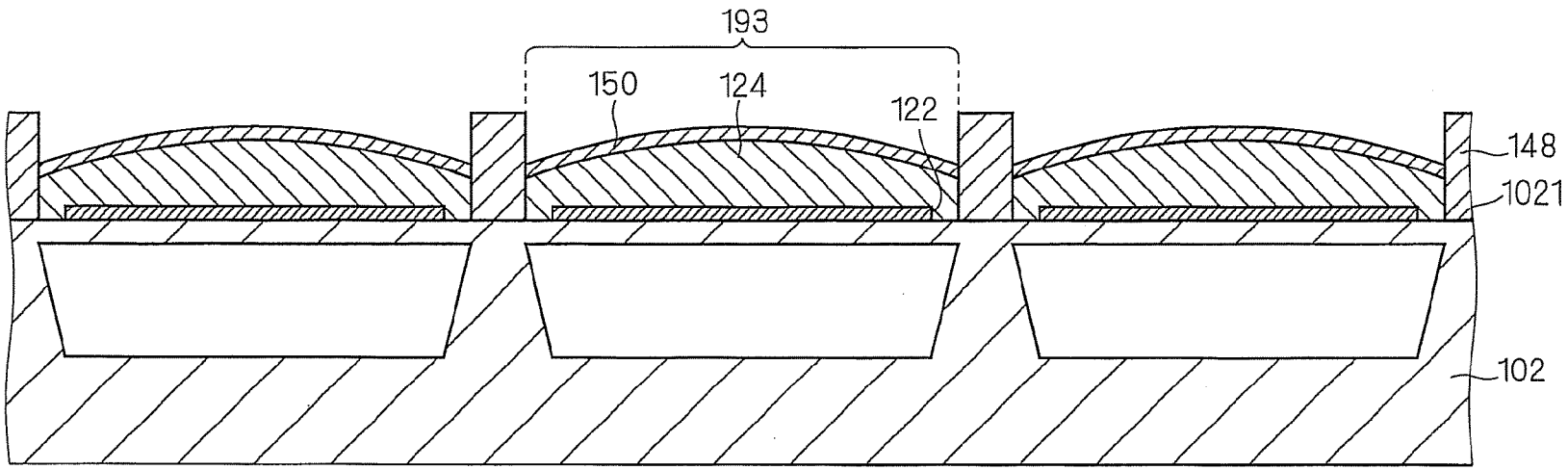
FIG. 19 is a cross-sectional view describing the method of manufacturing the vibrator according to the first embodiment.

After the formation of the resist pattern 148, as shown in FIG. 19, a conductive material film 150 which will later become the upper electrode film 126 is formed on the piezoelectric/electrostrictive film 124 in the piezoelectric/electrostrictive film forming region 193 on the upper surface 1021 of the substrate 102. Note that the resist pattern 148 will be removed later, and hence there occurs no problem if the conductive material film 150 comes out of the piezoelectric/electrostrictive film forming region 193. The conductive material film 150 can be formed in the same manner as the above-mentioned conductive material film 144.

Figure 20:
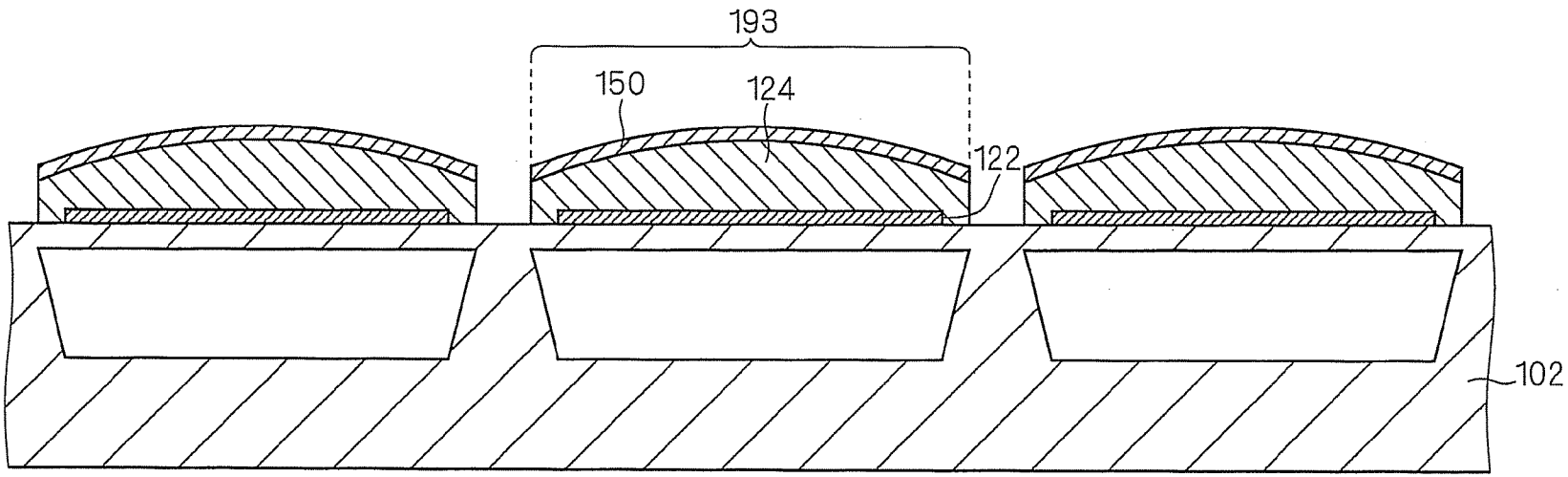
FIG. 20 is a cross-sectional view describing the method of manufacturing the vibrator according to the first embodiment.

After the formation of the conductive material film 150, as shown in FIG. 20, the resist pattern 148 remaining outside the piezoelectric/electrostrictive film forming region 193 is stripped and removed. As a result, the conductive material film 150 is formed at the same position as that of the piezoelectric/electrostrictive film 124 in plan view. The resist pattern 148 can be stripped in the same manner as the above-mentioned resist pattern 142.

Figure 21:
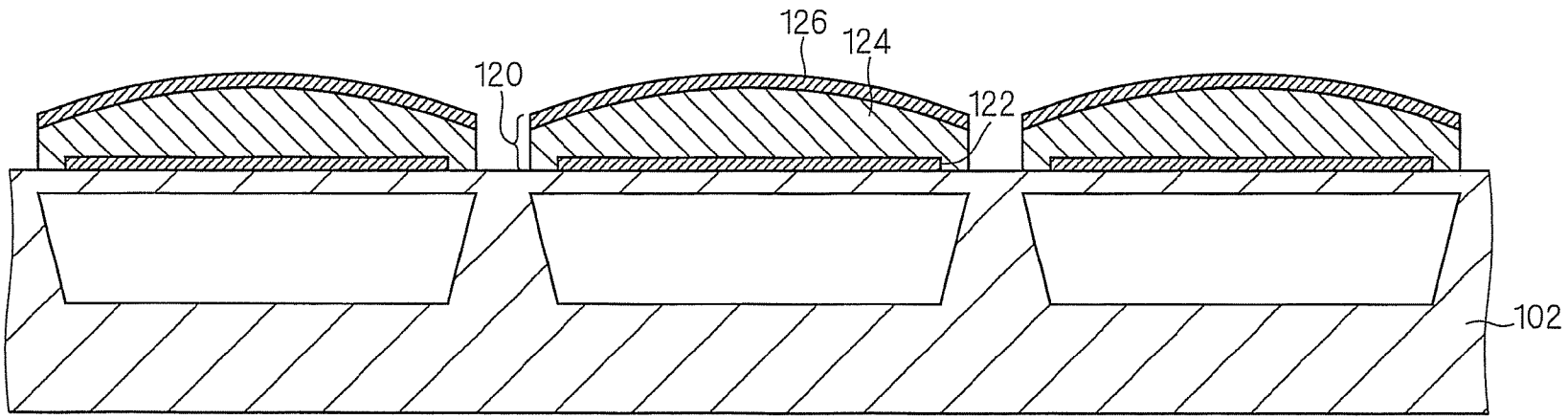
FIG. 21 is a cross-sectional view describing the method of manufacturing the vibrator according to the first embodiment.

After the resist pattern 148 is stripped, the conductive material film 150 is subjected to firing. As a result, as shown in FIG. 21, the conductive material film 150 becomes the upper electrode film 126, and the upper electrode film 126 is formed at the same position as that of the piezoelectric/electrostrictive film 124 in plan view. The firing of the conductive material film 150 can be performed in the same manner as the above-mentioned firing of the conductive material film 144.

(Formation of Upper Wiring Electrode 130)

After the formation of the conductive material film 150, the upper wiring electrode 130 is formed. The upper wiring electrode 130 can be formed in the same manner as the lower wiring electrode 128.

1-7 Method of Forming Resist Patterns 142 and 148

FIG. 22 to FIG. 28 are schematic views describing a method of manufacturing the resist patterns 142 and 148 according to the first embodiment. FIG. 22 to FIG. 28 are cross-sectional views of the substrate 102 and the resist patterns 142 and 148 in the course of the manufacture.

Figure 22:
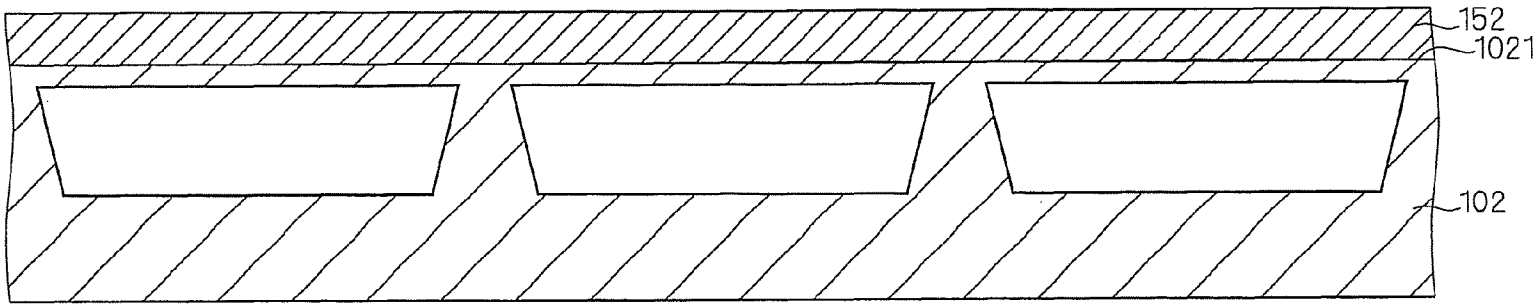
FIG. 22 is a cross-sectional view describing a method of forming a resist pattern according to the first embodiment.

In forming the resist pattern 142, first, as shown in FIG. 22, a resist film 152 covering the entire upper surface 1021 of the substrate 102 is formed. The resist film 152 is a negative photosensitive film whose solubility in a developer decreases when being exposed to light.

Figure 23:
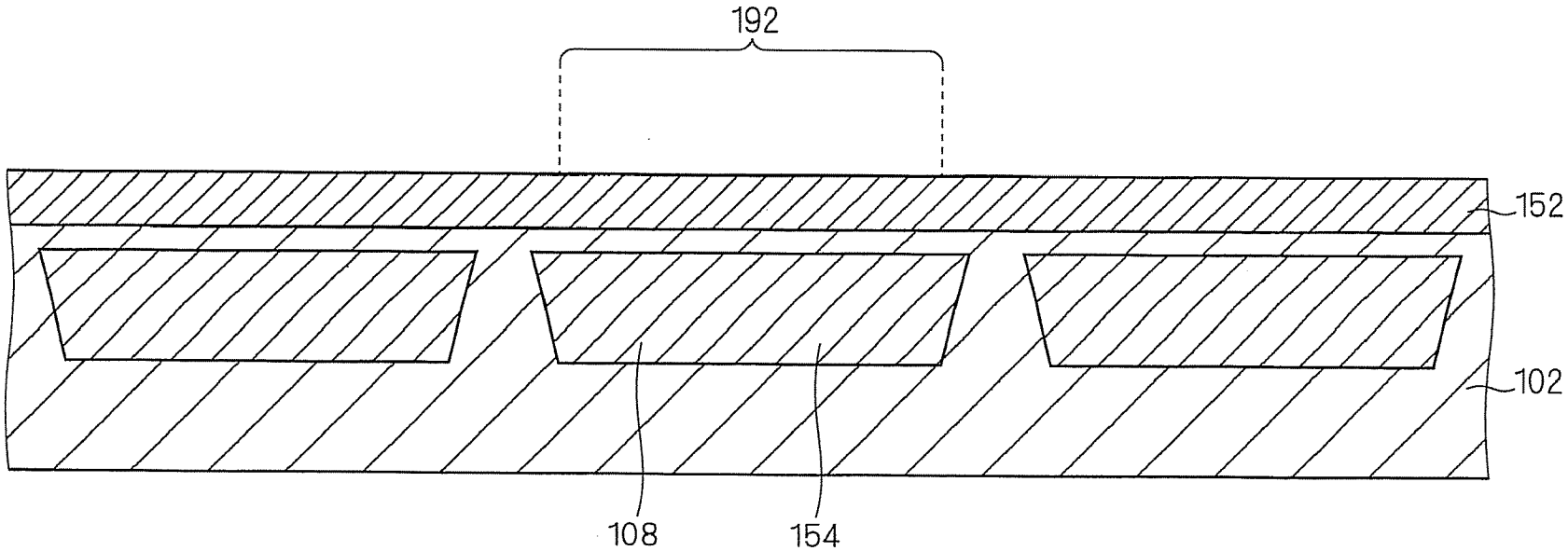
FIG. 23 is a cross-sectional view describing the method of forming the resist pattern according to the first embodiment.

After the formation of the resist film 152, as shown in FIG. 23, a light shielding agent 154 is filled in the cavities 108, and a function of a mask of shielding the lower electrode film forming region 192 is provided to the substrate 102. The substrate 102 is desirably a ceramic substrate in which the same types of insulating ceramic are subjected to cofiring. This is because, if an interface between different types of materials is eliminated from the substrate 102, light on the interface is suppressed from being refracted or scattered, whereby light required for patterning can be obtained stably. Moreover, the substrate 102 is desirably a translucent body. Therefore, insulating ceramic forming the substrate 102 is desirably, for example, yttrium oxide which allows light to pass therethrough or the like, zirconia, alumina or the like which allows light to pass therethrough easily. This is because light required for patterning can be sufficiently obtained if the substrate 102 is a translucent body.

Figure 24:
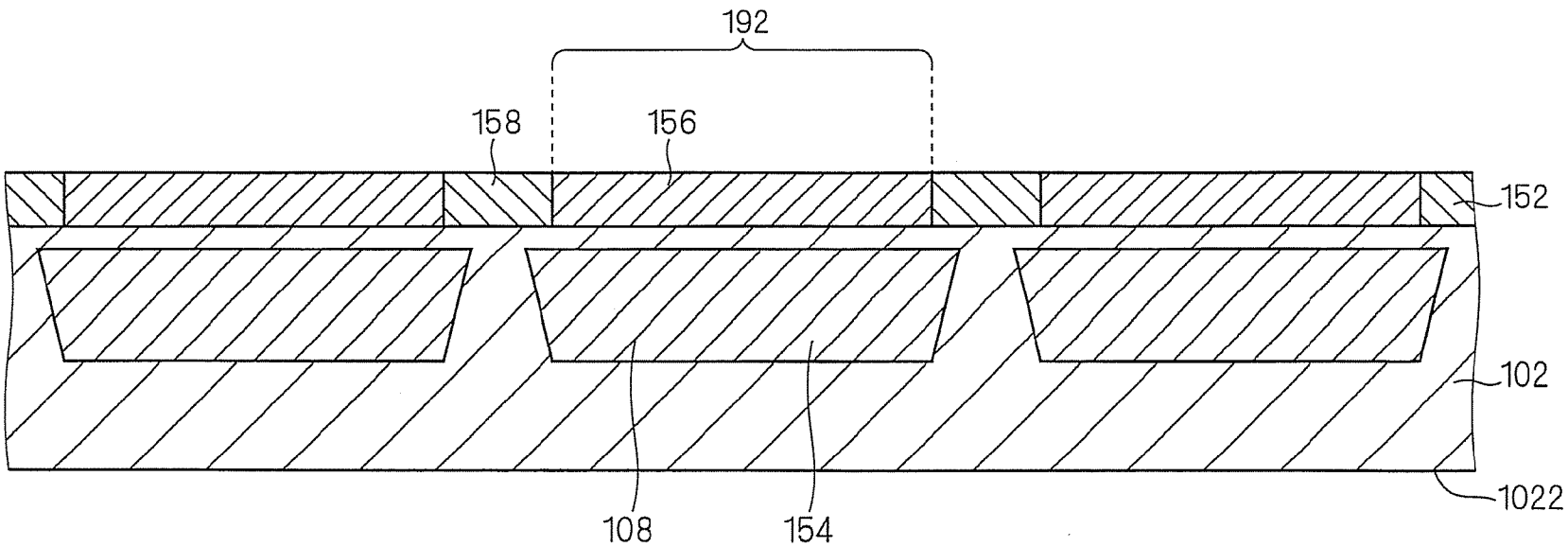
FIG. 24 is a cross-sectional view describing the method of forming the resist pattern according to the first embodiment.

The resist film 152 is formed, and the light shielding agent 154 is filled in the cavities 108. Then, as shown in FIG. 24, light is irradiated from the lower surface 1022 side of the substrate 102, and the resist film 152 formed outside the lower electrode film forming region 192 is selectively exposed to light, whereby an unexposed portion 156 and an exposed portion 158 are formed. Accordingly, a latent image obtained by inverting and transferring a shape in plan view of the cavity 108 is rendered in the resist film 152.

Figure 25:
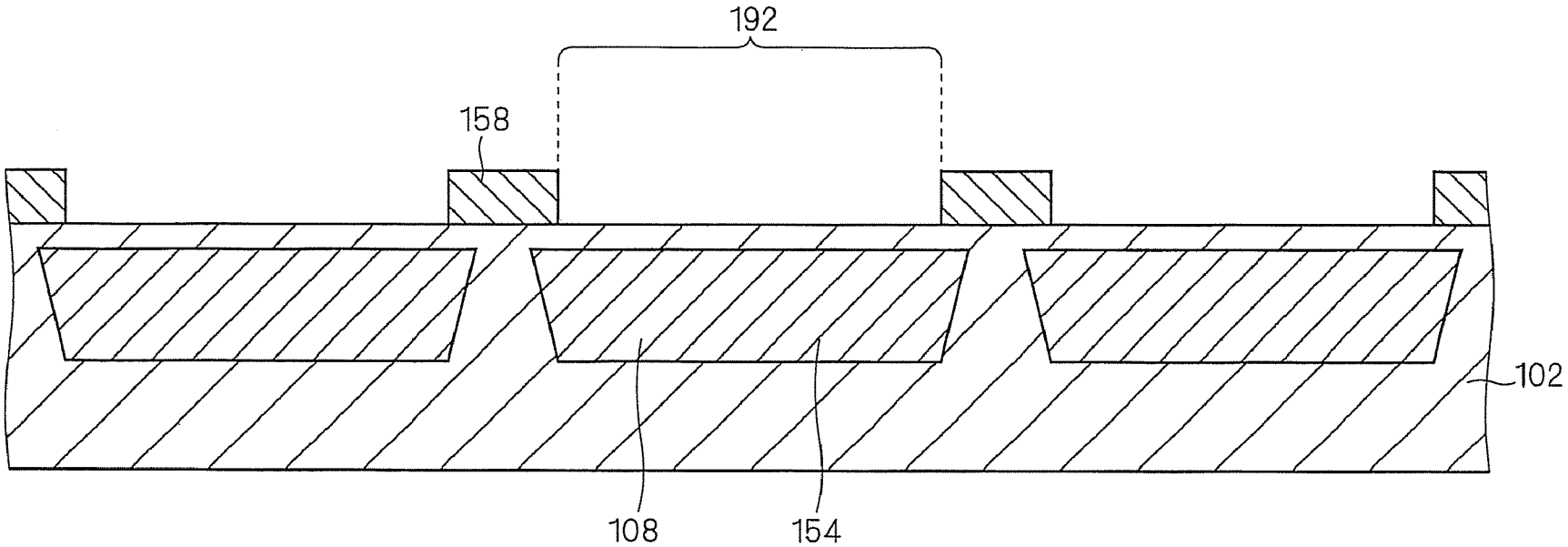
FIG. 25 is a cross-sectional view describing the method of forming the resist pattern according to the first embodiment.

After the latent image is rendered, as shown in FIG. 25, the unexposed portion 156 of the resist film 152, which is formed in the lower electrode film forming region 192, is removed by development.

After the development of the latent image, light is irradiated from the lower surface 1022 side of the substrate 102, whereby the exposed portion 158 remaining outside the lower electrode film forming region 192 is further exposed to light to be hardened through baking. Besides, the light shielding agent 154 is removed from the cavities 108. As a result, the resist pattern 142 shown in FIG. 12 is completed.

Note that in forming the resist pattern 142, it is possible to use a positive resist film whose solubility in a developer increases when being exposed to light in place of the negative resist film 152. In this case, using the fact that transmittance of light of the cavity 108 is higher than transmittance of light of the other part, a latent image obtained by inverting and transferring a shape in plan view of the cavity 108 is rendered in a resist film without filling the light shielding agent 154 in the cavities 108.

Figure 26:
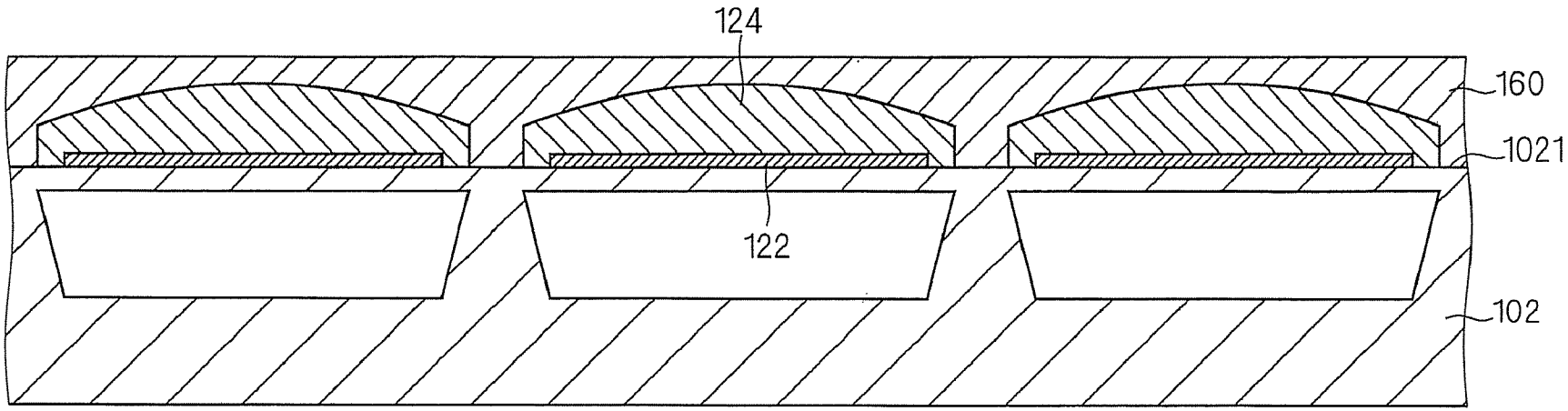
FIG. 26 is a cross-sectional view describing the method of forming the resist pattern according to the first embodiment.

On the other hand, in forming the resist pattern 148, first, as shown in FIG. 26, a resist film 160 covering the piezoelectric/electrostrictive film 124 is formed on the entire upper surface 1021 of the substrate 102. The resist film 160 is a negative photosensitive film whose solubility in a developer decreases when being exposed to light.

Figure 27:
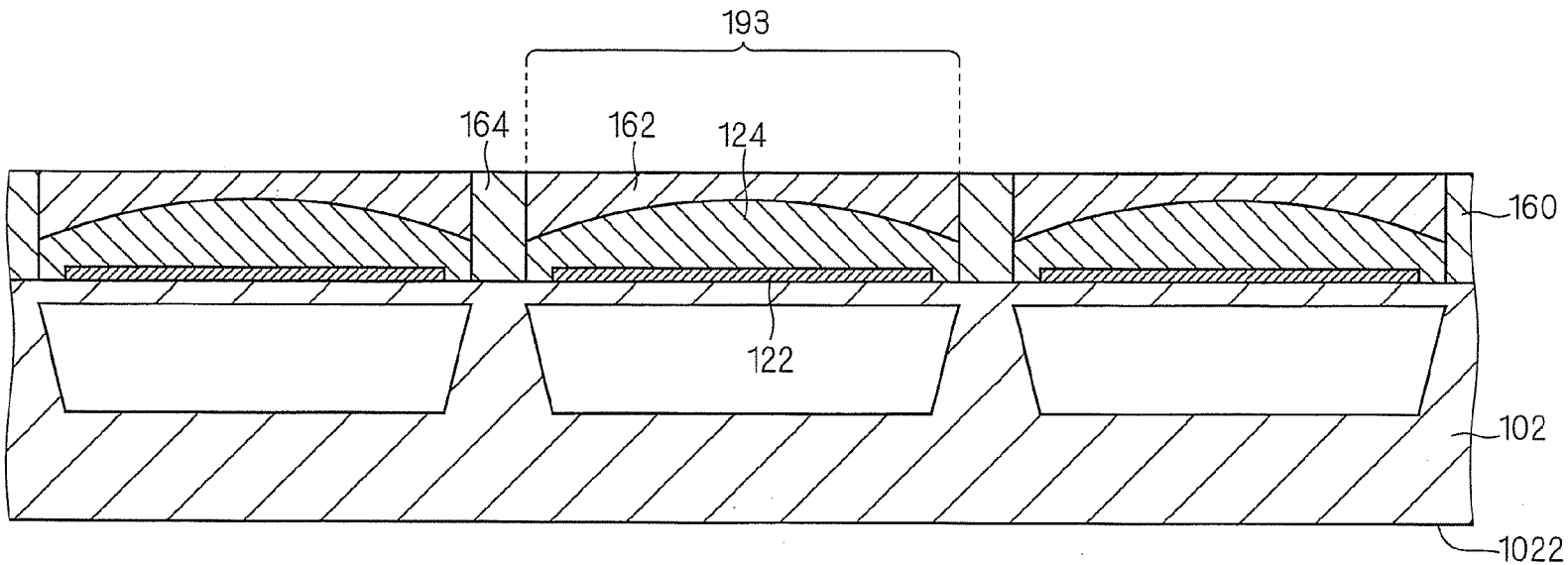
FIG. 27 is a cross-sectional view describing the method of forming the resist pattern according to the first embodiment.

After the formation of the resist film 160, as shown in FIG. 27, light is irradiated from the lower surface 1022 side of the substrate 102, and the resist film 160 formed outside the piezoelectric/electrostrictive film forming region 193 is selectively exposed to light, whereby an unexposed portion 162 and an exposed portion 164 are formed. Accordingly, a latent image obtained by inverting and transferring a shape in plan view of the piezoelectric/electrostrictive film 124 is rendered in the resist film 160.

Figure 28:
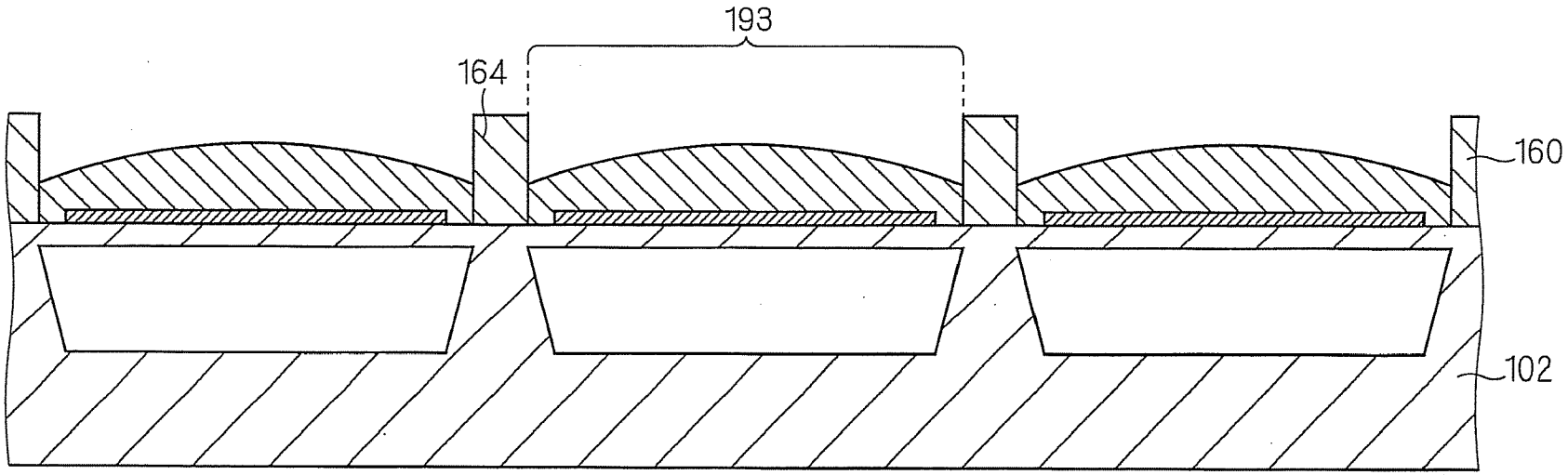
FIG. 28 is a cross-sectional view describing the method of forming the resist pattern according to the first embodiment.

After the latent image is rendered, as shown in FIG. 28, the unexposed portion 162 of the resist film 160, which is formed in the piezoelectric/electrostrictive film forming region 193, is removed by development.

After the development of the latent image, light is irradiated from the lower surface 1022 side of the substrate 102, and the exposed portion 164 remaining outside the piezoelectric/electrostrictive film forming region 193 is further exposed to light, whereby the exposed portion 164 is hardened by baking. As a result, the resist pattern 148 shown in FIG. 18 is completed.

1-8 Advantages of Method of Manufacturing Vibrator 120

According to the method of manufacturing the vibrator 120 as described above, it is possible to prevent a position in plan view of the cavity 108 and a position in plan view of the lower electrode film 122 from being misaligned, prevent the position in plan view of the lower electrode film 122 and a position in plan view of the piezoelectric/electrostrictive film 124 from being misaligned, and prevent the position in plan view of the piezoelectric/electrostrictive film 124 and a position in plan view of the upper electrode film 126 from being misaligned. Accordingly, it is possible to prevent the position in plan view of the cavity 108 and the positions in plan view of the lower electrode film 122, the piezoelectric/electrostrictive film 124, and the upper electrode film 126 which form the vibrator 120 from being misaligned. As a result, it is possible to prevent the position in plan view of the cavity 108 and the position in plan view of the vibrator 120 from being misaligned. This fact is contributory to suppressing variations in discharge amount of ink of a piezoelectric/electrostrictive actuator including the vibrator 120.

Further, in a case of using a resist pattern obtained by patterning with the substrate 102 which has different light transmittances in the portion of the cavity 108 and the other portion being as a photomask in forming the lower electrode film 122 being the film of the lowermost layer which forms the vibrator 120, the lower electrode film 122 is not formed in a peripheral portion of the vibration region 191 in which transmittance of light is close to that in a outside portion of vibration region 191. Accordingly, it is also possible to prevent the vibrator 120 from coming out of the vibration region 191, which causes a decrease in displacement amount of bending vibration.

Note that the above does not prevent all or part of the lower electrode film 122, the piezoelectric/electrostrictive film 124 and the upper electrode film 126 from being formed by a method different from the method described above, for example, by subjecting a coating film formed by screen printing to firing.

2 Second Embodiment

A second embodiment relates to a method of manufacturing a substrate 202 which can be used in place of the method of manufacturing the substrate 102 according to the first embodiment.

(2-1 Method of Manufacturing Substrate 202)

FIG. 6 is also a schematic view of a forming machine 280 which is used in manufacturing the substrate 202 according to the second embodiment. FIG. 7 is also a figure showing changes over time in temperature of a green sheet 232 and in load applied to a die 283. In addition, FIG. 29 to FIG. 32 are schematic views describing a method of manufacturing the substrate 202 according to the second embodiment. FIG. 29 to FIG. 32 are lateral cross-sectional views of the substrate 202 in the course of manufacture.

(Formation of Adhesion Layer 252)

Figure 29:
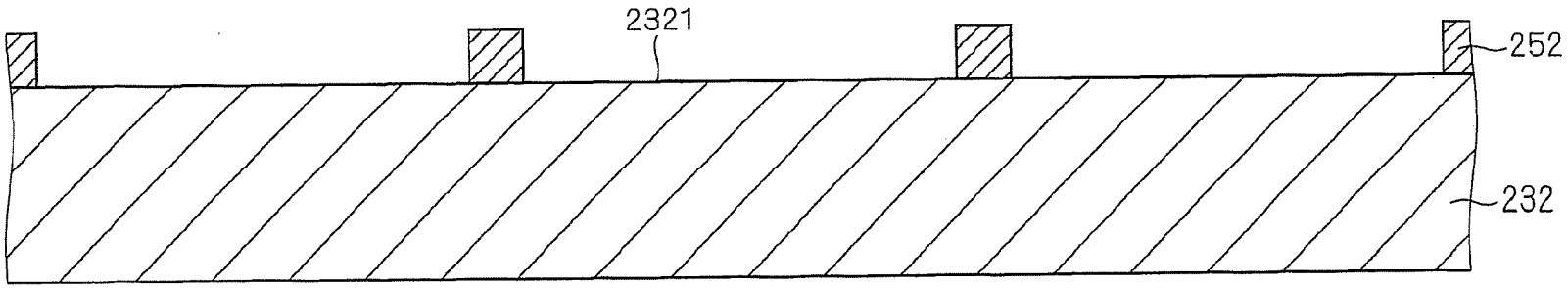
FIG. 29 is a cross-sectional view describing a method of manufacturing a substrate according to a second embodiment.

In manufacturing the substrate 202, first, as shown in FIG. 29, there is formed an adhesion layer 252 outside a region where dents 234 are formed on an upper surface 2321 of the green sheet 232, that is, a region to which the die 283 is press-fitted. It is desirable that the composition of the insulating ceramic contained in the adhesion layer 252 be substantially the same as the composition of the insulating ceramic contained in the green sheet 232. In addition, it is desirable that the adhesion layer 252 contain a large amount of a binder compared with the green sheet 232, and that a glass transition temperature of the adhesion layer 252 be lower than a glass transition temperature of the green sheet 232. A film thickness of the adhesion layer 252 is desirably approximately 30 to 50% of a depth of the dent 234, and is desirably set to 0.01 to 0.05 mm. A width of the adhesion layer 252 is desirably set to 0.01 to 0.08 mm. The adhesion layer 252 is formed by, for example, applying a paste in which a powder of insulating ceramic and a binder are dispersed in dispersion medium using a screen printing method or a spotting method. Note that the above does not prevent the adhesion layer 252 from being formed using the other method.

(Rise in Temperature of Green Sheet 232 (from Timing t1 to Timing t2))

Subsequently, in the same manner as the first embodiment, the green sheet 232 is placed on a suction table 282 which has been heated by the heater 281 to be sucked in vacuum. As a result, the green sheet 232 is fixed to the hot plate 282, and thus a temperature of the green sheet 232 is raised to the glass transition temperature Tg or higher.

(Press-Fitting of Die 283 to Green Sheet 232 (from Timing t2 to Timing t3))

Figure 30:
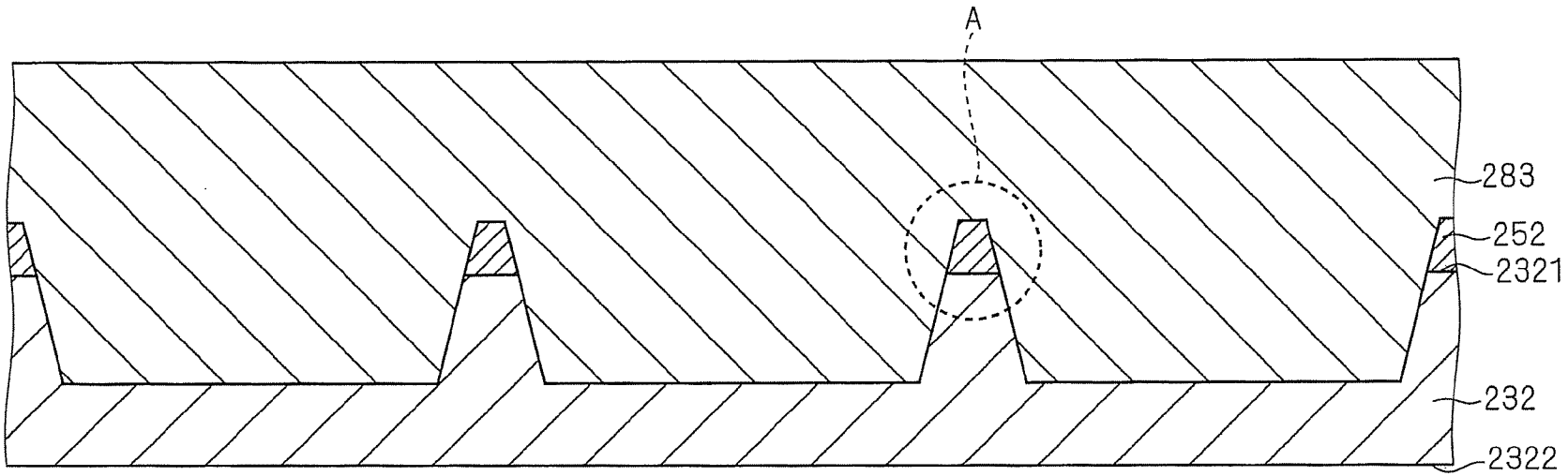
FIG. 30 is a cross-sectional view describing the method of manufacturing the substrate according to the second embodiment.

The temperature of the green sheet 232 is raised to the glass transition temperature Tg or higher, and then the die 283 is press-fitted to the upper surface 2321 of the green sheet 232 in the same manner as the first embodiment. When the die 283 is press-fitted to the green sheet 232 which is susceptible to plastic deformation by being heated in this manner, as shown in FIG. 30, the green sheet 232 undergoes plastic deformation, whereby a three-dimensional shape of the die 283 is transferred onto the upper surface 2321 of the green sheet 232.

Figure 34:
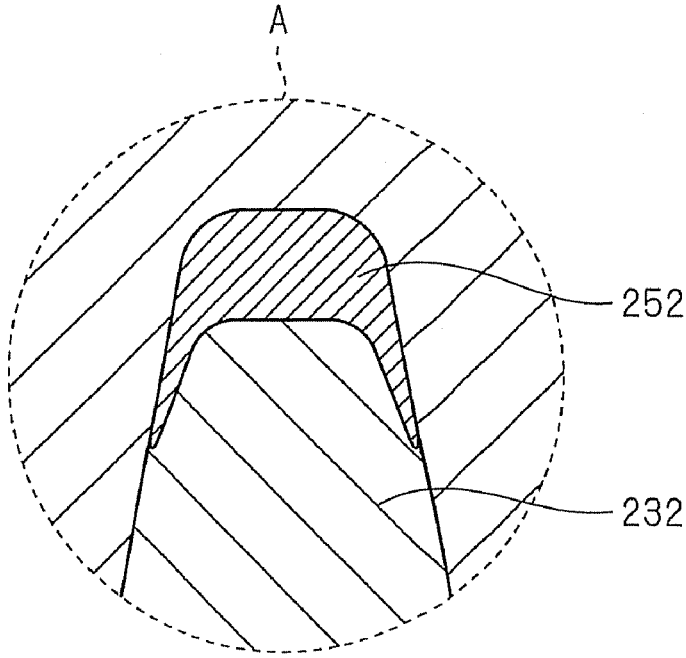
FIG. 34 is a view showing an enlarged part A of FIG. 30.

In press-fitting of the die 283 to the green sheet 232, it is desirable to bring the die 283 into contact with the adhesion layer 252 as well, and subject the adhesion layer 252 to plastic deformation by the die 283. As a result, the green sheet 232 and the adhesion layer 252 can form a three-dimensional structure which will later become the frame 206, whereby a depth of the dent 234 can be made deeper and a depth of a cavity 208 can be made deeper. In addition, as shown in FIG. 34 in which a part A of FIG. 30 is enlarged, there is generated no step between the green sheet 232 and the adhesion layer 252, whereby a surface of the three-dimensional structure can be made substantially flat. In a case where the die 283 is brought into contact with the adhesion layer 252, for improving die releasability between the adhesion layer 252 and the die 283, it is desirable to apply a die release agent to the die 283 or coat the die 283 with a fluororesin or the like.

(Holding of State in which Die 283 is Press-Fitted (from Timing t3 to Timing t4))

Subsequently, in the same manner as the first embodiment, a state in which the die 283 is press-fitted to the upper surface 2321 of the green sheet 232 is held.

(Decrease in Temperature of Green Sheet 232 (from Timing t4 to Timing t5))

Subsequently, heating of the hot plate 282 by the heater 281 is stopped while keeping the state in which the die 283 is press-fitted to the upper surface 2321 of the green sheet 232, whereby the temperature of the green sheet 232 is decreased below the glass transition temperature Tg. Naturally, in a case where the die 283 is also heated, the heating of the die 283 is stopped as well.

(Separation Between Green Sheet 232 and Die 283 (from Timing t5 to Timing t6))

The temperature of the green sheet 232 is decreased below the glass transition temperature Tg, and then the green sheet 232 and the die 283 are separated from each other. In this case, the green sheet 232 has lost most of its elasticity, and thus spring back hardly occurs, whereby the dents 234 which will later become the cavities 208 are formed on the upper surface 2321 of the green sheet 232.

(Formation of Through Hole 236)

Figure 31:
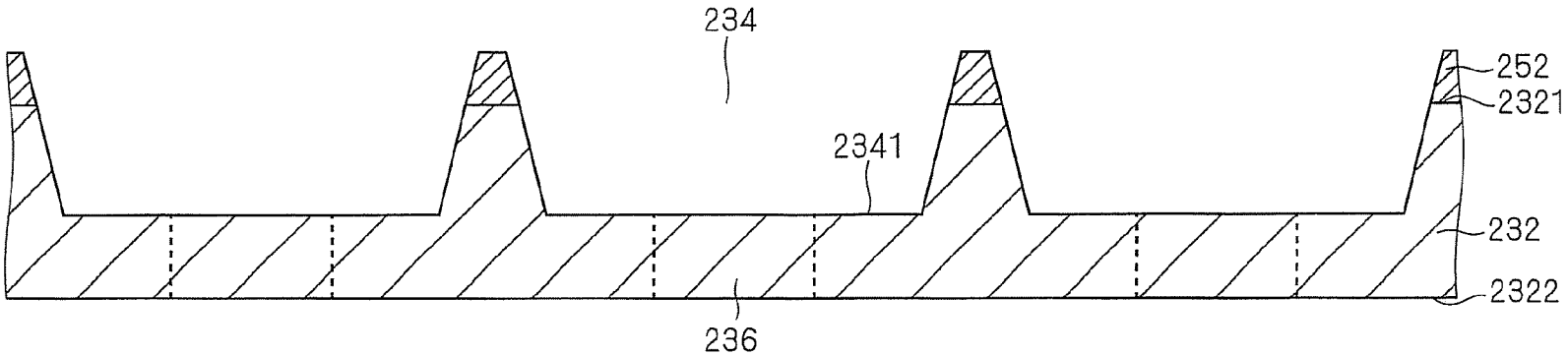
FIG. 31 is a cross-sectional view describing the method of manufacturing the substrate according to the second embodiment.

Subsequently, as shown in FIG. 31, through holes 236 each penetrating from a lower inner surface 2341 of the dent 234 to a lower surface 2322 of the green sheet 232 are formed in the green sheet 232 in the same manner as the first embodiment.

(Thermocompression-Bonding of Green Sheets 238 and 240)

Figure 32:
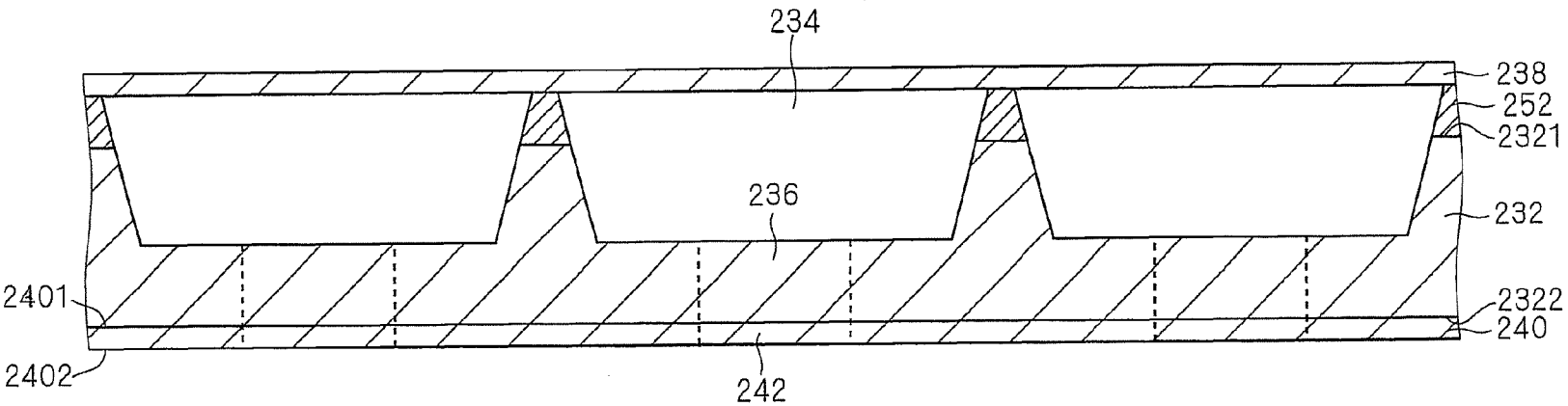
FIG. 32 is a cross-sectional view describing the method of manufacturing the substrate according to the second embodiment.

Subsequently, as shown in FIG. 32, a green sheet 238 and a green sheet 240 are thermocompression-bonded to the adhesion layer 252 on the upper surface 2321 of the green sheet 232 and the lower surface 2322 of the green sheet 232, respectively, in the same manner as the first embodiment. In the green sheet 240, through holes 242 each penetrating from an upper surface 2401 to an lower surface 2402 are formed at the same positions as those of the through holes 236. The green sheet 238 is thermocompression-bonded in this manner, whereby the dents 234 become voids inside a press-bonded body. Note that in the case where the glass transition temperature of the adhesion layer 252 is lower than the glass transition temperature of the green sheet 232 as described above, it is possible to soften only the adhesion layer 252 without considerably softening the green sheet 232 due to heating during thermocompression bonding. Accordingly, it is possible to suppress the green sheet 232 from deforming due to pressurization when the green sheet 240 is thermocompression-bonded, with the result that accuracy of a dimension of the substrate 202, for example, accuracy of a relative position between unit structures can be improved.

(Cofiring)

Figure 33:
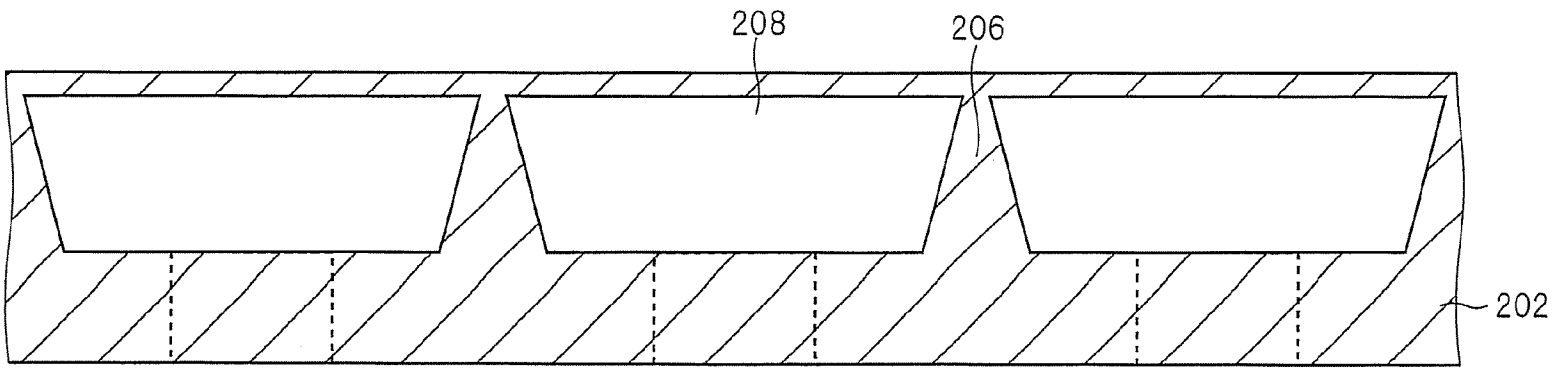
FIG. 33 is a cross-sectional view describing the method of manufacturing the substrate according to the second embodiment.

Subsequently, the green sheets 232, 238 and 240 and the adhesion layer 252 are subjected to cofiring as in the same manner as the first embodiment. Accordingly, the substrate 202 as shown in FIG. 33, which is integrated and has high rigidity, can be obtained.

The substrate 202 as described above can be used in place of the substrate 102 according to the first embodiment, and has an advantageous effect that the depth of the cavity 208 can be made deeper to increase a discharge amount of droplets.

3 Third Embodiment

A third embodiment relates to a cavity 308 which can be used in place of the cavity 108 according to the first embodiment.

Figure 35:
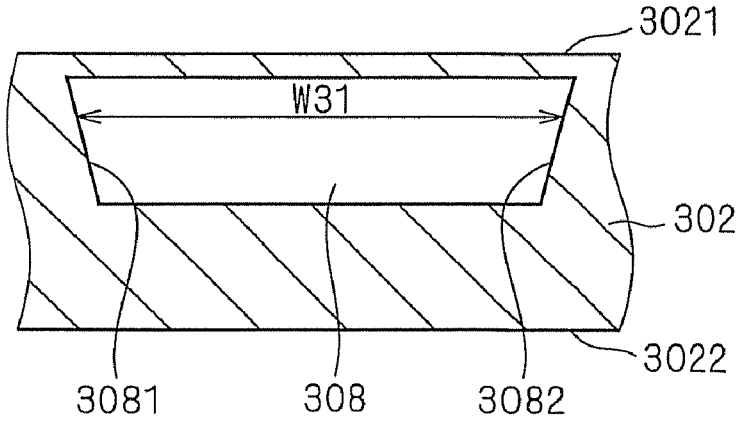
FIG. 35 is a cross-sectional view showing a shape of a cavity according to a third embodiment.
Figure 36:
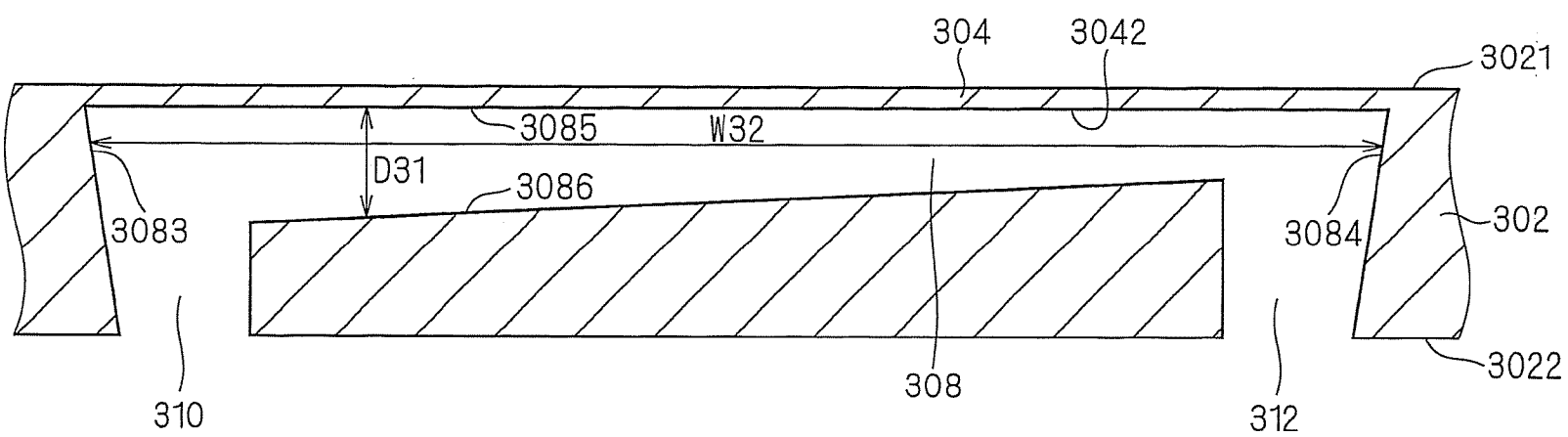
FIG. 36 is a cross-sectional view showing the shape of the cavity according to the third embodiment.

FIG. 35 and FIG. 36 are schematic views of a substrate 302 in which the cavity 308 is formed. FIG. 35 is a lateral cross-sectional view of the substrate 302 in cross section similar to that of FIG. 2, and FIG. 36 is a longitudinal cross-sectional view of the substrate 302 in cross section similar to that of FIG. 3.

As shown in FIG. 35, inner side surfaces 3081 and 3082 in a short side direction of the cavity 308 are inclined from a surface perpendicular to an upper surface 3021 of the substrate 302 along the short side direction of the cavity 308 in the same manner as the first embodiment. The inner side surface 3081 and the inner side surface 3082 are relatively apart from each other on the upper surface 3021 side of the substrate 302, and are relatively close to each other on a lower surface 3022 side of the substrate 302. Accordingly, a lateral width W31, which is a dimension of the cavity 308 in the short side direction parallel to the upper surface 3021 of the substrate 302, becomes narrower from the upper surface 3021 side of the substrate 302 toward the lower surface 3022 side of the substrate 302.

On the other hand, in the third embodiment, inner side surfaces 3083 and 3084 in a long side direction of the cavity 308 are also inclined from the surface perpendicular to the upper surface 3021 of the substrate 302 along the long side direction of the cavity 308 as shown in FIG. 36. The inner side surface 3083 and the inner side surface 3084 are relatively apart from each other on the upper surface 3021 side of the substrate 302, and are relatively close to each other on the lower surface 3022 side of the substrate 302. Accordingly, a longitudinal width W32, which is a dimension of the cavity 308 in the long side direction parallel to the upper surface 3021 of the substrate 302, becomes narrower from the upper surface 3021 side of the substrate 302 toward the lower surface 3022 side of the substrate 302.

As shown in FIG. 36, an upper inner surface 3085 of the cavity 308, that is, a lower surface 3042 of a vibration plate 304 is parallel to the upper surface 3021 of the substrate 302 in the same manner as the first embodiment. In addition, a lower inner surface 3086 of the cavity 308 is inclined from the surface parallel to the upper surface 3021 of the substrate 302 along the long side direction of the cavity 308 in the same manner as the first embodiment. Accordingly, a depth D31, which is a dimension of the cavity 308 in a direction perpendicular to the upper surface 3021 of the substrate 302, becomes deeper from a supply hole 312 side toward a discharge hole 310 side.

Even if the above-mentioned cavity 308 is used in place of the cavity 108, it is possible to increase a displacement amount of bending vibration while suppressing interference between adjacent unit structures, whereby a discharge amount of droplets can be increased.

4 Fourth Embodiment

A fourth embodiment relates to a cavity 408 which can be used in place of the cavity 108 according to the first embodiment.

Figure 37:
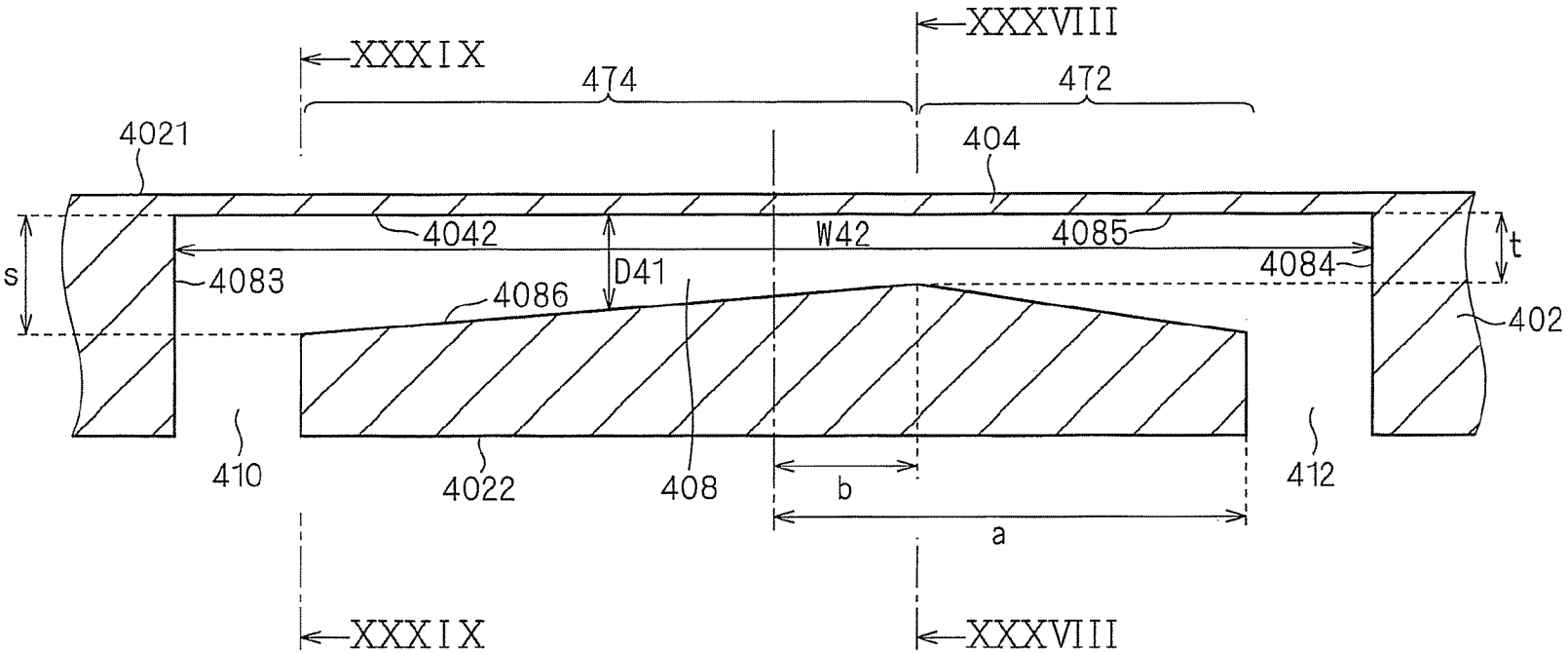
FIG. 37 is a cross-sectional view showing a shape of a cavity according to a fourth embodiment.
Figure 38:
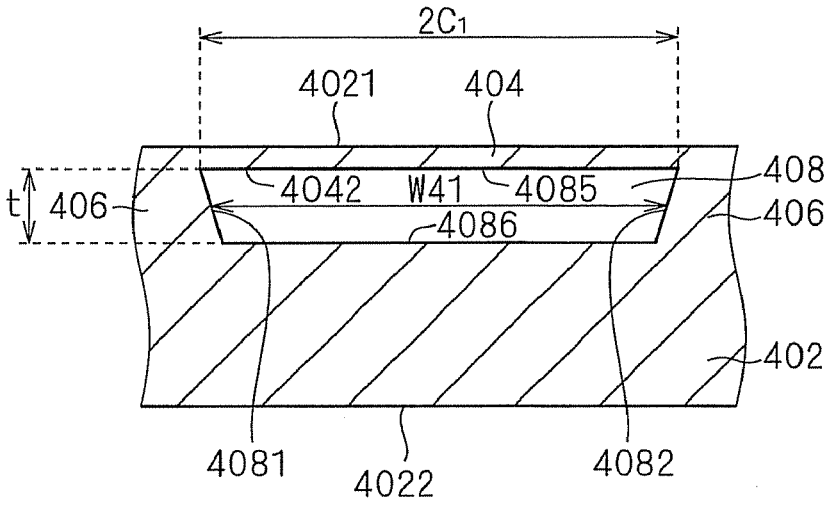
FIG. 38 is a cross-sectional view showing the shape of the cavity according to the fourth embodiment.
Figure 39:
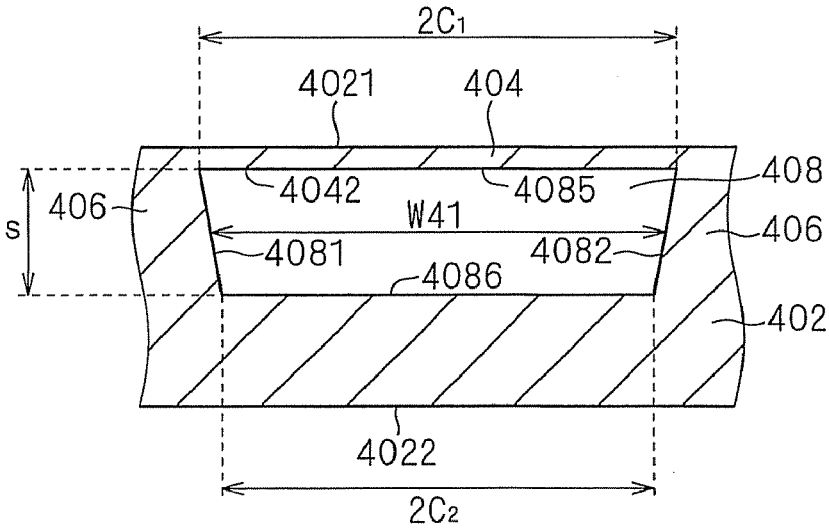
FIG. 39 is a cross-sectional view showing the shape of the cavity according to the fourth embodiment.

FIG. 37 to FIG. 39 are schematic views of a substrate 402 in which a cavity 408 is formed. FIG. 37 is a longitudinal cross-sectional view of the substrate 402 in a cross section similar to that of FIG. 3, FIG. 38 is a lateral cross-sectional view of the substrate 402 which is taken along XXXVIII-XXXVIII of FIG. 37, and FIG. 39 is a lateral cross-sectional view of the substrate 402 which is taken along of FIG. 37.

As shown in FIG. 37, an upper inner surface 4085 of the cavity 408, that is, a lower surface 4042 of a vibration plate 404 is parallel to an upper surface 4021 of the substrate 402 along the same manner as the first embodiment. In addition, a bottom inner surface 4086 of the cavity 408, which is opposed to the lower surface 4042 of the vibration plate 404, is inclined from a surface parallel to the upper surface 4021 of the substrate 402 in a long side direction of the cavity 408. However, the bottom inner surface 4086 of the cavity 408 is closer to the lower surface 4042 of the vibration plate 404 from a supply hole 412 side toward a discharge hole 410 side in a first part 472 which is positioned on the supply hole 412 side and occupies a relatively small area, whereas the bottom inner surface 4086 of the cavity 408 is apart from the lower surface 4042 of the vibration plate 404, from the supply hole 412 side toward the discharge hole 410 side in a second part 474 which is positioned on the discharge hole 410 side and occupies a relatively large area. Accordingly, a depth D41, which is a dimension of the cavity 408 in a direction perpendicular to the upper surface 4021 of the substrate 402, becomes shallower from the supply hole 412 side toward the discharge hole 410 side in the first part 472, and becomes deeper from the supply hole 412 side toward the discharge hole 410 side in the second part 474. The cavity 408 is tapered from the discharge hole 410 side toward the supply hole 412 side in the second part which is positioned on the discharge hole 410 side and occupies a relatively large area in this manner, whereby a flow of a liquid from the discharge hole 410 side toward the supply hole 412 side is impeded. Accordingly, it is possible to suppress the liquid from being discharged from the supply hole 412 when the vibration plate 404 is subjected to bending vibration and the liquid filled in the cavity 408 is pressed, with the result that a discharge amount of droplets from the discharge hole 410 can be increased.

Inner side surfaces 4081 to 4084 and the upper inner surface 4085 of the cavity 408 are flat surfaces without steps. In addition, the bottom inner surface 4086 of the cavity 408 is also a flat surface without a step in each of the first part 472 and the second part 474. Therefore, a lateral width W41 of the cavity 408 becomes narrower in a continuous manner from the upper surface 4021 side of the substrate 402 toward the lower surface 4022 side of the substrate 402. A depth D41 of the cavity 408 becomes shallower in a continuous manner from the supply hole 412 side toward the discharge hole 410 side in the first part 472 and becomes deeper in a continuous manner from the supply hole 412 side toward the discharge hole 410 side in the second part 474. If the steps that cause bubbles are reduced from the inner side surfaces 4081 to 4084, the upper inner surface 4085 and the lower inner surface 4086 of the cavity 408, it is possible to suppress bubbles from occurring inside the cavity 408.

In contrast to the cavity 108, the cavity 408 has an advantage that undulations of the lower surface 4022 of the substrate 402, which result from a density difference of a green sheet after the die is pressure-bonded, can be suppressed. That is, in the case of using the cavity 108, undulations are likely to occur in such a manner that the lower surface 1022 of the substrate 102 protrudes downward. On the other hand, in the case of using the cavity 408, a contribution to the undulations in the first part 472 and a contribution to the undulations in the second part 474 can be canceled with each other, whereby the undulations are unlikely to occur in such a manner that the lower surface 4022 of the substrate 402 protrudes downward.

As shown in FIG. 38 and FIG. 39, the inner side surfaces 4081 and 4082 in a short side direction of the cavity 408 are inclined from a surface perpendicular to the upper surface 4021 of the substrate 402 along the short side direction of the cavity 408 as in the case of the first embodiment. The inner side surface 4081 and the inner side surface 4082 are relatively apart from each other on the upper surface 4021 side of the substrate 402, and are relatively close to each other on the lower surface 4022 side of the substrate 402. Accordingly, a lateral width W41, which is a dimension of the cavity 408 in the short side direction parallel to the upper surface 4021 of the substrate 402, becomes narrower from the upper surface 4021 side of the substrate 402 toward the lower surface 4022 side of the substrate 402. If the cavity 408 is tapered from the upper surface 4021 side of the substrate 402 toward the lower surface 4022 side of the substrate 402 in this manner, it is possible to increase a lateral width of the vibration plate 404 while keeping strength of a frame 406 between the adjacent cavities 408. As a result, it is possible to increase a displacement amount of bending vibration while suppressing interference between adjacent unit structures, with the result that a discharge amount of droplets can be increased.

Meanwhile, as shown in FIG. 37, the inner side surfaces 4083 and 4084 in the long side direction of the cavity 408 are perpendicular to the upper surface 4021 of the substrate 402. For this reason, a longitudinal width W42, which is a dimension of the cavity 408 in the long side direction parallel to the upper surface 4021 of the substrate 402, is uniform.

Also when the above-mentioned cavity 408 is used in place of the cavity 108, it is possible to increase a displacement amount of bending vibration while suppressing interference between adjacent unit structures, whereby a discharge amount of droplets can be increased.

As to the fourth embodiment, it is not necessarily required to adhere a lower electrode film and a vibration plate to each other by interdifussion reaction, and no limitation is imposed on a structure of a vibrator which bends the vibration plate 404. Therefore, the present application includes the following invention.

A droplet discharge device, which includes:

a substrate in which a cavity separated from a first main surface by a vibration plate, a first liquid flow path extending from the cavity to an outside, and a second liquid flow path extending from the outside to the cavity are formed; and a vibrator fixed to the vibration plate and subjecting the vibration plate to bending vibration, wherein:

a depth being a dimension of the cavity in a first direction perpendicular to the first main surface becomes shallower, in a first part positioned on the second liquid flow path side and occupying a relatively small area, from the second liquid flow path side toward the first liquid flow path side; and the depth of the cavity becomes deeper, in a second part positioned on the first liquid flow path side and occupying a relatively large area, from the second liquid flow path side to the first liquid flow path side.

EXAMPLES

Part 1

Figure 46:
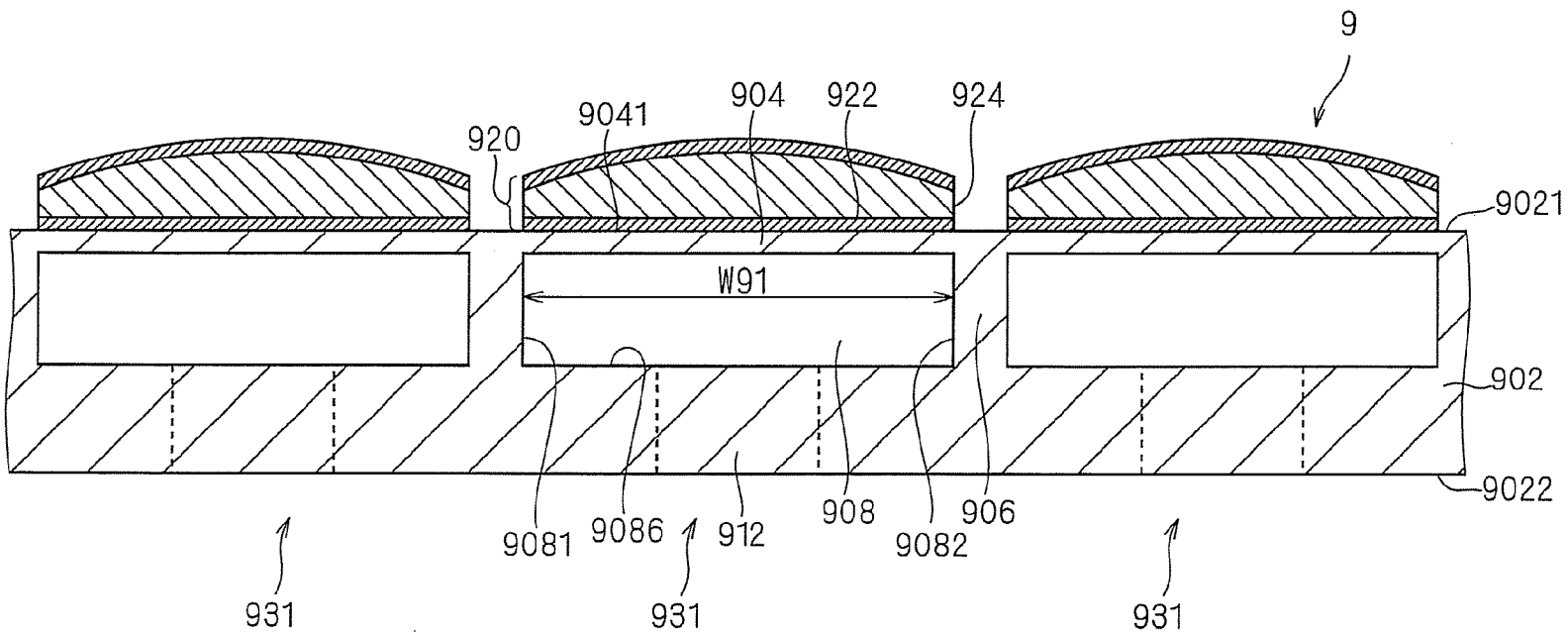
FIG. 46 is a cross-sectional view of the droplet discharge device, which is taken along XLVI-XLVI of FIG. 45.

The following description will be given of results obtained by evaluating characteristics of prototyped droplet discharge devices 1 and 9 which include the cavity 108 having the trapezoidal shape in lateral cross section as shown in FIG. 2 and a cavity 908 having a rectangular shape in lateral cross section as shown in FIG. 46, respectively. In this prototyping, the substrate 102 and a substrate 902 were made of zirconia, thicknesses of the vibration plate 104 and a vibration plate 904 were from 1 to 3 μm, the depths D11 and D13 being dimensions of the cavity 108 were equal to each other (same shape in longitudinal cross section as that of FIG. 47), a width WC at upper ends of the cavities 108 and 908 were 60 μm (see FIG. 43), and arrangement intervals of the unit structures 131 and unit structures 931 were 70 μm. A displacement amount of bending displacement was measured by a laser Doppler method.

(Relative Displacement Amount and Crosstalk)

Figure 40:
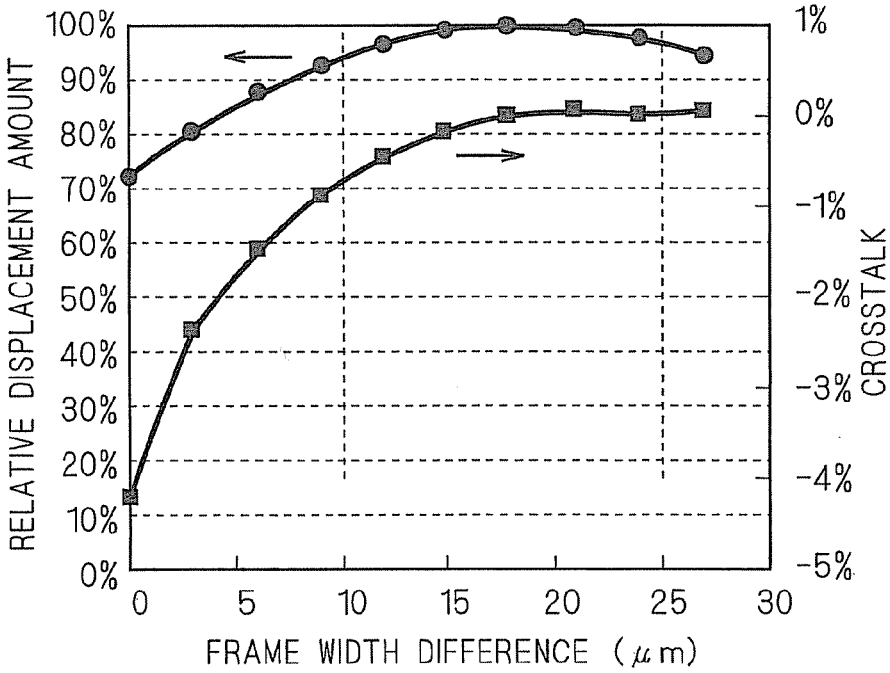
FIG. 40 is a graph showing changes in relative displacement amount and crosstalk in a case where a frame width difference is changed.

A graph of FIG. 40 shows changes in a relative displacement amount and crosstalk in a case where frame width differences DW=WL−WU (see FIG. 43) between frame widths WU at the upper ends of the frames 106 and 906 and frame widths WL at lower ends thereof were changed. It goes without saying that the cavity 108 having a trapezoidal shape in lateral cross section as shown in FIG. 2 is obtained in a case where DW>0, and that the cavity 908 having a rectangular shape in lateral cross section as shown in FIG. 46 is obtained in a case where DW=0. This fact is similar in "coverages of the lower electrode film 122 and a lower electrode film 922" and "rates of defective cracks of the vibration plates 104 and 904", which will be subsequently described.

The "relative displacement amount" herein refers to, in a case where only the vibrator 120 positioned at the center of three adjacent vibrators 120 and the vibrator 920 positioned at the center of three adjacent vibrators 920 are driven, a relative value when the largest value of bending displacement amounts R1 of the vibration plates 104 and 904 to which the vibrator 120 positioned at the center is fixed is assumed to be 100%. In addition, the "crosstalk" herein refers to a ratio (R3−R1)/R1 of a difference R3−R1 to the bending displacement amount R1. The difference R3−R1 is a difference between bending displacement amounts R3 of the vibration plates 104 and 904 to which the vibrators 120 and 920 positioned at the center are fixed in a case where all of the three adjacent vibrators 120 and the three adjacent vibrators 920 are driven at the same time and the bending displacement amounts R1 of the vibration plates 104 and 904 to which the vibrator 120 and 920 positioned at the center is fixed in the case where the only vibrators 120 and 920 positioned at the center among the three adjacent vibrators 120 and the three adjacent vibrators 920 are driven.

As shown in FIG. 40, the relative displacement amount becomes the largest when the frame width difference DW is approximately 18 μm, increases as the frame width difference DW becomes larger when the frame width difference DW falls below approximately 18 μm, and decreases as the frame width difference DW becomes larger when the frame width difference DW exceeds approximately 18 μm. This is because, if the frame width difference DW becomes too small, the coverages of the lower electrode films 122 and 922 increase, whereby areas of parts of the vibration plates 104 and 904, which are not covered by the lower electrode films 122 and 922 and are susceptible to bending, become narrower. On the other hand, if the frame width difference DW becomes too large, the coverages of the lower electrode films 122 and 922 decrease, whereby areas of parts of the piezoelectric/electrostrictive film 124 and a piezoelectric/electrostrictive film 924, to which an electrical field is applied, become smaller.

Meanwhile, an absolute value of crosstalk becomes smaller as the frame width difference DW increases.

Considering the relative displacement amount and crosstalk comprehensively, a desirable range of the frame width difference DW is roughly from 10 to 25 μm.

(Coverages of Lower Electrode Films 122 and 922)

Figure 41:
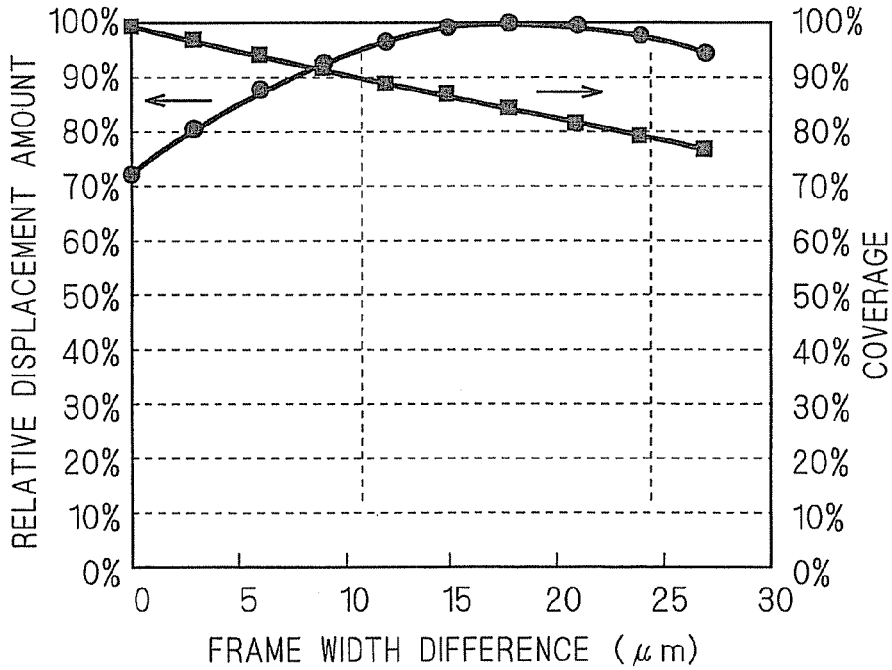
FIG. 41 is a figure showing changes in relative displacement amount and coverage of a lower electrode film in the case where the frame width difference is changed.

A graph of FIG. 41 shows changes in relative displacement amount and in coverage of the lower electrode films 122 and 922 in a case where the frame width difference DW=WL−WU was changed. The "coverage" herein refers to a ratio WE/WC (see FIG. 43) of a width WE which is dimensions of the lower electrode films 122 and 922 in the short side direction to a width WC which is dimensions of the cavities 108 and 908, that is, the vibration plates 104 and 904 in the short side direction.

As shown in FIG. 41, the coverage decreases as the frame width difference DW increases. This is because, if the frame width difference DW increases, light can easily pass through a vicinity of an end portion of the cavity 108 in the substrate 102 in which the light shielding agent 154 is filled in the cavities 108 and which serves as a mask.

Considering a relative displacement amount, a desirable coverage range is from 80 to 90%. This desirable coverage range is also similar in the case where the cavity 308 or the cavity 408 is used in place of the cavity 108.

Figure 43:
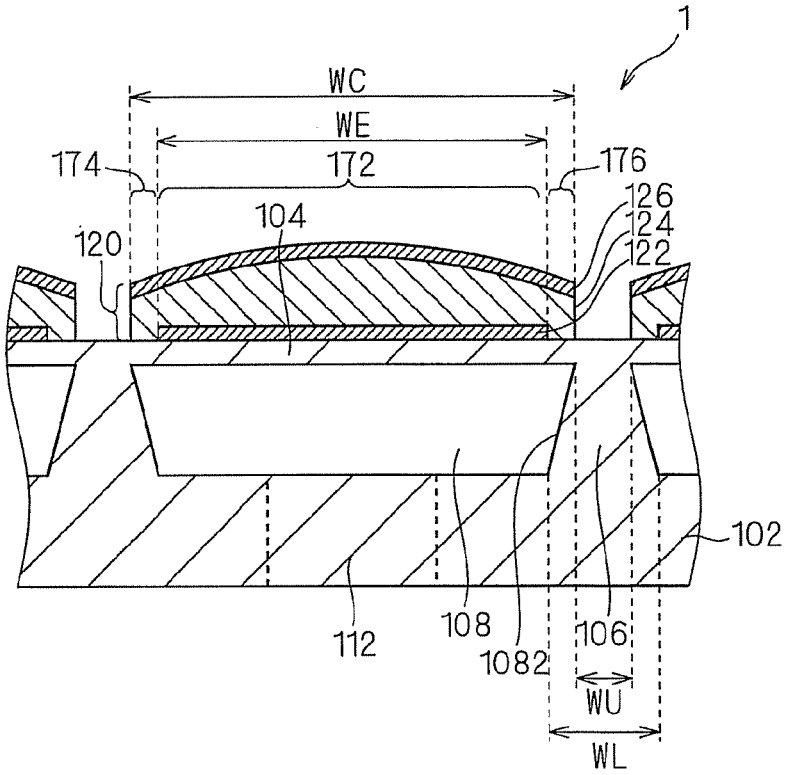
FIG. 43 are cross-sectional views describing dimensions of respective parts of the droplet discharge device.
Figure 43:
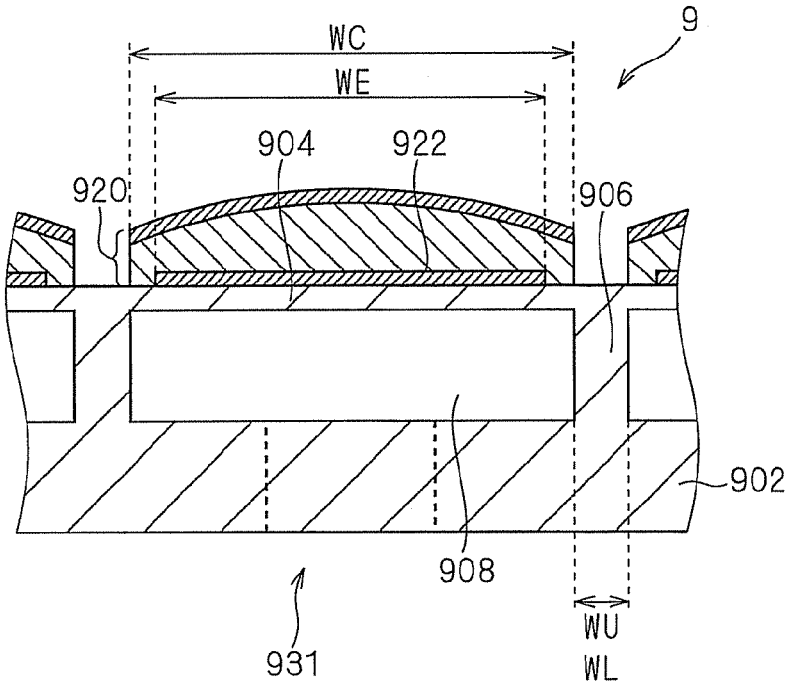
Figure 45:
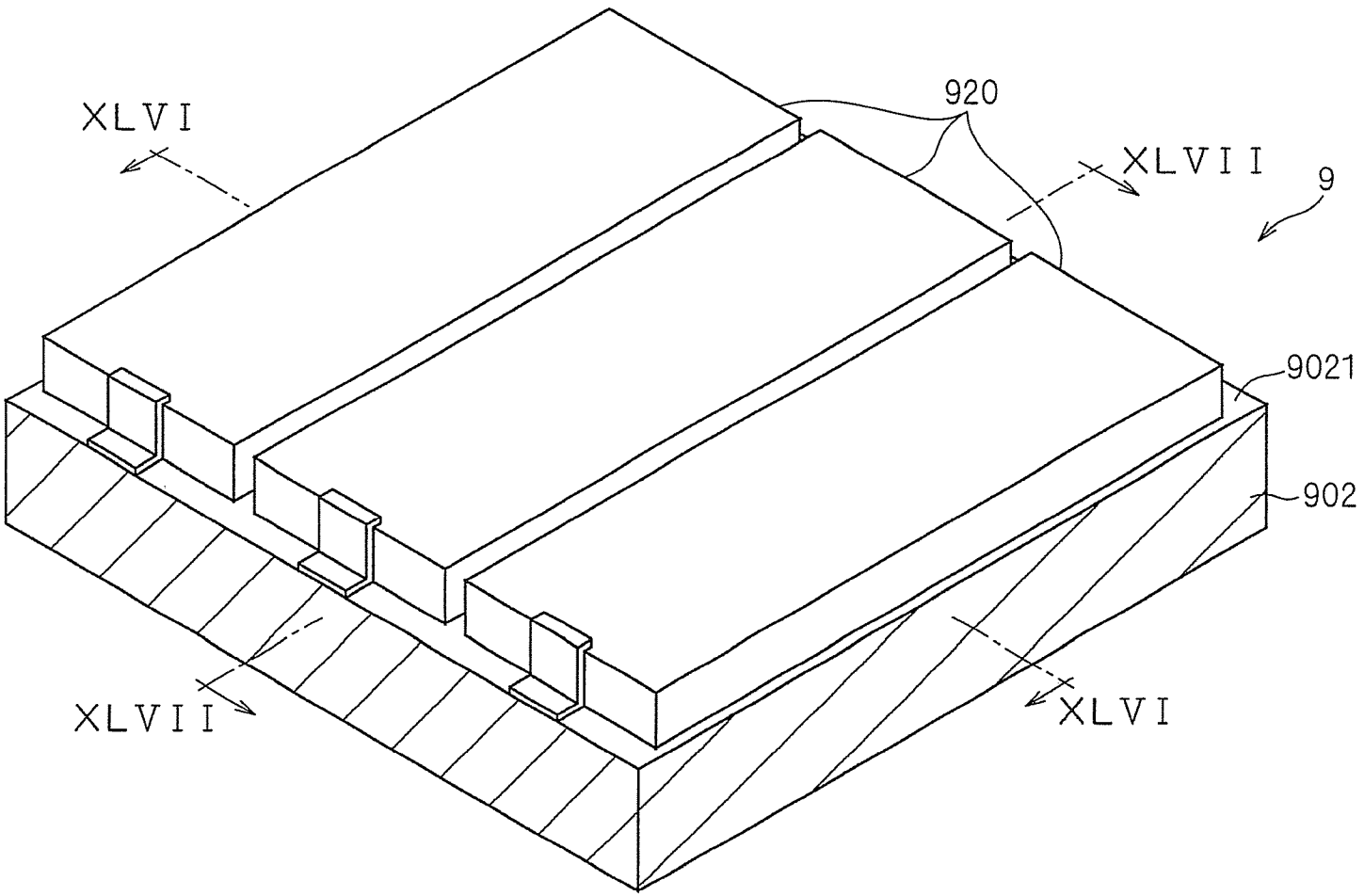
FIG. 45 is a perspective view of a conventional droplet discharge device.

In the case of using the cavity 108 having a "trapezoidal" shape in lateral cross section, in the vibration plate 104, unadhered regions 174 and 176 which have the same dimension in the short side direction and to which the lower electrode film 122 is not adhered are formed on both sides in the short side direction of a fixed region 172 which are covered by the lower electrode film 122, that is, to which the lower electrode film 122 is adhered (see FIG. 43(*a*)). The fact that the unadhered regions 174 and 176 which are susceptible to bending are positioned on the both sides of the unadhered region 172 is contributory to an improvement in relative displacement amount.

(Rates of Defective Cracks of Vibration Plates 104 and 904)

Figure 42:
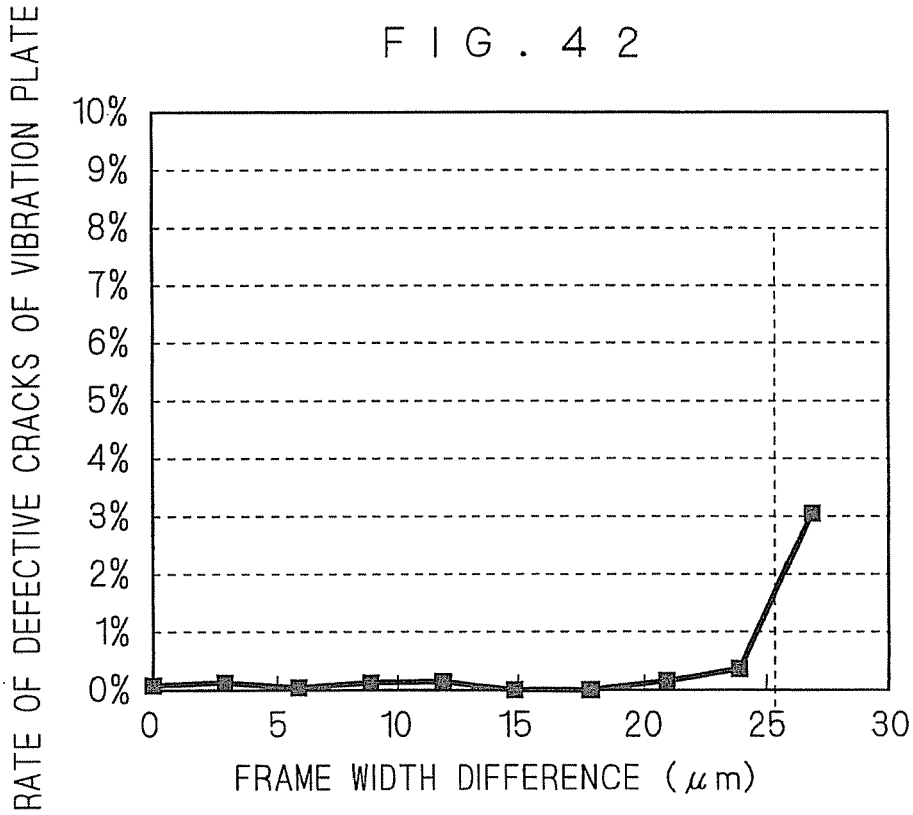
FIG. 42 is a figure showing a rate of defective cracks of a vibration plate in the case where the frame width difference is changed.

A graph of FIG. 42 shows a change in rate of defective cracks of the vibration plates 104 and 904 in the case where the frame width difference DW=WL−WU was changed.

As shown in FIG. 42, when the frame width difference DW exceeds approximately 25 μm, the rate of defective cracks of the vibration plates 104 and 904 increase remarkably. This is because, if the frame width difference DW becomes too large, areas of parts of the vibration plates 104 and 904, which are not covered by the lower electrode films 122 and 922 functioning also as a protective film, become large.

Part 2

The following description will be given of results obtained by evaluating characteristics of prototyped droplet discharge devices which include the cavities 108 and 408 having the shapes in longitudinal cross section as shown in FIG. 3 and FIG. 37, respectively. In this prototyping, the substrates 102 and 402 were made of zirconia, the thicknesses of the vibration plates 104 and 404 were from 1 to 3 μm, the depths D11 and D13 being dimensions of the cavity 108 were such that D11≧D13, a width $2C_1$ at the upper ends of the cavities 108 and 408 was 60 μm, a difference $2C_1-2C_2$ between the width $2C_1$ at the upper ends of the cavities 108 and 408 and a width $2C_2$ at lower ends of the cavities 108 and 408 at positions where the cavities 108 and 408 become the deepest was from 10 to 25 μm, and a depth s of the cavities 108 and 408 at the positions where the cavities 108 and 408 become the deepest was from 60 to 80 μm (see FIG. 37 to FIG. 39).

(Effect of a Ratio $A_2/A_1$ Between Sectional Areas in Lateral Cross Section)

Table 1 shows changes in variations a in width of the lower electrode film 122, in undulations of the substrates 104 and 404 and in discharge amount of droplets in a case where a ratio $A_2/A_1$ of a sectional area $A_2$ in lateral cross section of the cavities 108 and 408 at positions where the cavities 108 and 408 become the shallowest to a sectional area $A_1$ in lateral cross section of the cavities 108 and 408 at the positions where the cavities 108 and 408 become the deepest. The ratio $A_2/A_1$ is calculated by Expression (1).

TABLE 1

| $A_2/A_1$ | 0.5 | 0.6 | 0.7 | 0.8 | 0.9 | 1 |
|---|---|---|---|---|---|---|
| lower electrode σ | large | ○ | ○ | ○ | ○ | ○ |
| undulations of substrate | x | ○ | ○ | ○ | x | x |
| discharge amount | 1.05 | 1.19 | 1.21 | 1.14 | 1.07 | 1 |

[Expression 1]

$$\frac{A_2}{A_1} = \frac{t}{(C_1 + C_2)S^2}\{(2S - t)C_1 + C_2 t\} \quad (1)$$

Table 1 shows results when a ratio b/a which will be described below was from 0.7 to 0.9. It goes without saying that the cavity 408 having the shape in longitudinal cross section which is shown in FIG. 37 can be obtained if the depth s and the depth t are different from each other, and that the cavity 108 having the shape in longitudinal cross section which is shown in FIG. 3 and also having a shape in longitudinal cross section in a case where D11=D13 (same shape in longitudinal cross section as that of FIG. 47) can be obtained if the depth s and the depth t are not different from each other.

The "variations in width of the lower electrode film 122" herein refers to a difference between a width being a dimension of the lower electrode film 122 in the short side direction at the positions where the cavities 108 and 408 become the shallowest and a width being a dimension of the lower electrode film 122 in the short side direction at the positions where the cavities 108 and 408 become the deepest. The reason why variations occur in width of the lower electrode film 122 is that the light shielding agent shields light more insufficiently as the position becomes closer to the position where the cavity 408 becomes the shallowest, and accordingly the width of the unexposed portion 156 of the resist film 152 becomes narrower. The "discharge amount" herein refers to a relative value with a value when the ratio $A_2/A_1$=1 being 1.

As shown in Table 1, variations in width of the lower electrode film 122 cause no problem when the ratio $A_2/A_1$ is from 0.6 to 1, while the variations become large if the ratio $A_2/A_1$ is smaller than 0.6. As a result, the discharge amount remarkably decreases if the ratio $A_2/A_1$ is smaller than 0.6. On the other hand, the discharge amount remarkably decreases also if the ratio $A_2/A_1$ is larger than 0.8.

Further, as shown in Table 1, undulations of the substrate cause no problem if the ratio $A_2/A_1$ is from 0.6 to 0.8, while the variations cause a problem if the ratio $A_2/A_1$ falls outside this range.

From the above, the ratio $A_2/A_1$ is desirably in a range of 0.6 to 0.8.

(Effect of Distance Ratio b/a)

Table 2 shows changes in discharge amount, backflow amount and other problem in a case where a ratio b/a of a distance b between a center position in the long side direction of the cavity and the position where the cavity 408 becomes the shallowest to a distance a between the center position and the position where the cavity 408 becomes the deepest. It goes without saying that the cavity 408 having the shape in longitudinal cross section which is shown in FIG. 37 can be obtained if the ratio b/a is not 1, and the cavity 108 having the shape in longitudinal cross section which is shown in FIG. 3 and also having the shape in longitudinal cross section in a case where D11>D13 can be obtained if the ratio b/a is 1. Table 2 shows results when the above-mentioned ratio $A_2/A_1$ was from 0.6 to 0.8.

TABLE 2

| b/a | 0.5 | 0.6 | 0.7 | 0.8 | 0.9 | 1 |
|---|---|---|---|---|---|---|
| discharge amount | 1.2 | 1.2 | 1.2 | 1.2 | 1.2 | 1.2 |
| backflow amount | increase | increase | equal | equal | decrease | decrease |
| other problem | | | | | | die release is not performed in a stable manner |

The "discharge amount" herein refers to a relative value of a discharge amount of droplets discharged from the discharge hole 410 when the discharge amount of droplets discharged from the discharge hole 410 in the case where the sectional area ratio $A_2/A_1$ in lateral cross section of Table 1 is 1.

The "backflow amount" herein refers to results obtained by comparing a discharge amount of droplets discharged from the supply hole 412 with the discharge amount when the sectional area ratio $A_2/A_1$ in lateral cross section of Table 1 is 1.

As shown in Table 2, the discharge amount is increased by 1.2 times in the entire range where the ratio b/a is from 0.5 to 1.0.

In addition, as shown in Table 2, the backflow amount is the same or decreases if the ratio b/a is from 0.7 to 1, while the backflow amount increases if the ratio is smaller than 0.7.

Moreover, there arises no problem if the ratio b/a is within the range of 0.5 to 0.9, whereas there arises a problem that die release is not performed in a stable manner if the ratio b/a is larger than 0.9.

From the above, the ratio b/a is desirably in a range of 0.7 to 0.9.

Part 3

(Discharge Amount of Droplets)

Figure 47:
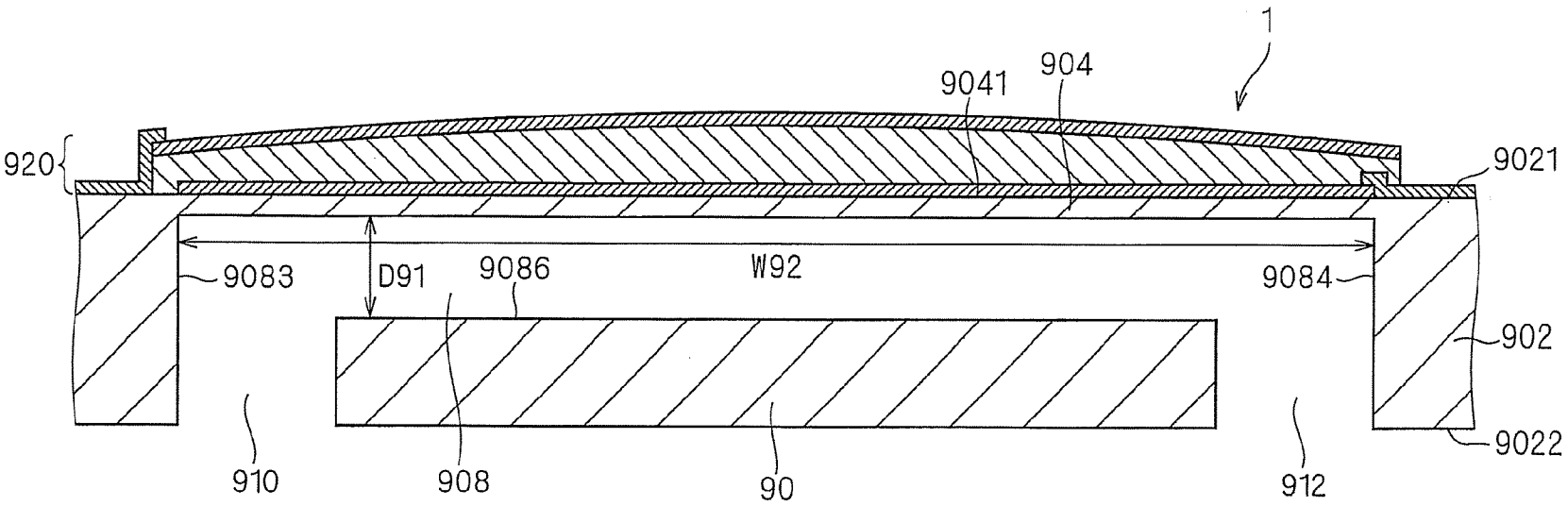
FIG. 47 is a cross-sectional view of the droplet discharge device, which is taken along XLVII-XLVII of FIG. 45.

Columns of Inventive Examples 1 and 2 of the list of FIG. 44 show the depth of the cavity 108 and the discharge amount of droplets of the droplet discharge device 1 which includes the cavity 108 having a trapezoidal shape in longitudinal cross section as shown in FIG. 3. Further, columns of Comparative Example 1 of the list of FIG. 44 show the depth of the cavity 908 and the discharge amount of droplets of the droplet discharge device 9 having a rectangular shape in longitudinal cross section as shown in FIG. 47. The "discharge amount of droplets" herein refers to total weights of droplets discharged from each of the discharge holes 110 and 910 when the vibrators 120 and 920 are driven a predetermined number of times, which is a relative value when a value of Comparative Example 1 is "1". Note that in Inventive Examples 1 and 2 and Comparative Example 1, the lateral widths W11 and W91 at the uppermost ends were set to 180 μm, and the lateral widths W12 and W92 at the uppermost ends were set to 1.1 mm.

As shown in FIG. 44, the discharge amount of droplets can be increased in the case where the cavity has the trapezoidal shape in longitudinal cross section than in the case where the cavity has the rectangular shape in longitudinal cross section.

While the invention has been shown and described in detail, the foregoing description is in all aspects illustrative and not restrictive. It is therefore understood that numerous modifications which is not illustrated can be devised without departing from the scope of the invention. Particularly, it is naturally assumed to appropriately combine the technologies described above.

The invention claimed is:

1. A droplet discharge device, comprising:

a substrate including in which a cavity separated from a first main surface by a vibration plate, a first liquid flow path extending from said cavity to an outside, and a second liquid flow path extending from the outside to said cavity are formed; and a vibrator fixed to said vibration plate and subjecting said vibration plate to bending vibration, wherein:

a width being a dimension of said cavity in a specific direction parallel to said first main surface becomes narrower from said first main surface side toward a second main surface side;

said vibrator includes:

a piezoelectric/electrostrictive film extending in parallel to said first main surface;

a first electrode film extending in parallel to said first main surface and adhered to said vibration plate by interdiffusion reaction; and a second electrode film extending in parallel to said first main surface and opposed to said first electrode film with said piezoelectric/electrostrictive film being sandwiched therebetween;

a width being a dimension of a adhered region in said specific direction to which said first electrode film is adhered is 80% or more and 90% or less of a width being a dimension of said vibration plate in said specific direction; and said vibration plate includes, on both sides of said adhered region, unadhered regions which have equal width being a dimension in said specific direction and to which said first electrode film is not adhered.

2. The droplet discharge device according to claim 1, wherein said width of said cavity becomes narrower in a continuous manner from said first main surface side toward said second main surface side.

3. The droplet discharge device according to claim 1, wherein:

a plurality of unit structures each including said cavity, said first liquid flow path, said second liquid flow path, and said vibrator fixed to said vibration plate separating said cavity from said first main surface of said substrate are arranged; and said width of said cavity in an arrangement direction of said unit structures becomes narrower from said first main surface side toward said second main surface side.

4. The droplet discharge device according to claim 1, wherein said substrate is a ceramic substrate obtained by subjecting same types of ceramic to cofiring.

5. The droplet discharge device according to claim 1, wherein said substrate is a translucent body.

6. A droplet discharge device, comprising:

a substrate in which a cavity separated from a first main surface by a vibration plate, a first liquid flow path extending from said cavity to an outside, and a second liquid flow path extending from the outside to said cavity are formed: and a vibrator fixed to said vibration plate and subjecting said vibration plate to bending vibration, wherein:

a depth being a dimension of said cavity in a first direction perpendicular to said first main surface becomes deeper from said second liquid flow path side to said first liquid flow path side;

said vibrator includes:

a piezoelectric/electrostrictive film extending in parallel to said first main surface;

a first electrode film extending in parallel to said first main surface and adhered to said vibration plate by interdiffusion reaction; and a second electrode film extending in parallel to said first main surface and opposed to said first electrode film with said piezoelectric/electrostrictive film being sandwiched therebetween;

a width being a dimension in a second direction parallel to said first main surface of an adhered region to which said first electrode film is adhered is 80% or more and 90% or less of a width being a dimension in said second direction of said vibration plate; and said vibration plate includes, on both sides of said adhered region, unadhered regions which have equal width being a dimension in said second direction and to which said first electrode film is not adhered.

7. The droplet discharge device according to claim 6, wherein said depth of said cavity becomes deeper in a continuous manner from said second liquid flow path side toward said first liquid flow path side.

8. The droplet discharge device according to claim 6, wherein said substrate is a ceramic substrate obtained by subjecting same types of ceramic to cofiring.

9. The droplet discharge device according to claim 6, wherein said substrate is a translucent body.

10. A droplet discharge device, comprising:

a substrate in which a cavity separated from a first main surface by a vibration plate, a first liquid flow path extending from said cavity to an outside and a second liquid flow path extending from the outside to said cavity are formed: and a vibrator fixed to said vibration plate and subjecting said vibration plate to bending vibration, wherein:

in a first part positioned on said second flow path side and occupying a relatively small area, a depth being a dimension of said cavity in a first direction perpendicular to said first main surface becomes shallower from said second liquid flow path side toward said first liquid flow path side;

in a second part positioned on said first liquid flow path side and occupying a relatively large area, said depth of said cavity becomes deeper from said second liquid flow path side toward said first liquid flow path side;

said vibrator includes:

a piezoelectric/electrostrictive film extending in parallel to said first main surface;

a first electrode film extending in parallel to said first main surface and adhered to said vibration plate by interdiffusion reaction; and a second electrode film extending in parallel to said first main surface and opposed to said first electrode film with said piezoelectric/electrostrictive film being sandwiched therebetween;

a width being a dimension in a second direction parallel to said first main surface of a adhered region to which said first electrode film is adhered is 80% or more and 90% or less of a width being a dimension in said second direction of said vibration plate; and said vibration plate includes, on both sides of said adhered region, unadhered regions which have equal width being said dimension in said second direction and to which said first electrode film is not adhered.

11. The droplet discharge device according to claim 10, wherein:

said depth of said cavity becomes shallower in a continuous manner from said second liquid flow path side toward said first liquid flow path side in said first part; and said depth of said cavity becomes deeper in a continuous manner from said second liquid flow path side toward said first liquid flow path side in said second part.

12. The droplet discharge device according to claim 10, wherein said substrate is a ceramic substrate obtained by subjecting same types of ceramic to cofiring.

13. The droplet discharge device according to claim 10, wherein said substrate is a translucent body.

14. A method of manufacturing a droplet discharge device, comprising the steps of:

(a) manufacturing a substrate in which a cavity separated from a first main surface by a vibration plate, a first liquid flow path extending from said cavity toward an outside, and a second liquid flow path extending from the outside to said cavity are formed; and (b) manufacturing a vibrator fixed to said vibration plate and subjecting said vibration plate to bending vibration, wherein said step (a) includes the steps of:

(a-1) raising a temperature of a first ceramic green sheet to a glass transition temperature or higher;

(a-2) press-fitting a die having a three-dimensional shape corresponding to a three-dimensional shape of said cavity to said first main surface of said first ceramic green sheet after said step (a-1);

(a-3) decreasing said temperature of said first ceramic green sheet below the glass transition temperature while keeping a state in which said die is press-fitted to said first main surface of said first ceramic green sheet;

(a-4) separating said first ceramic green sheet and said die from each other after said step (a-3);

(a-5) thermocompression-bonding a second ceramic green sheet on said first main surface side of said first ceramic green sheet in which a dent is formed by the press-fitting of said die after said step (a-4); and (a-6) subjecting said first ceramic green sheet and said second ceramic green sheet to cofiring after said step (a-5).

15. The method of manufacturing a droplet discharge device according to claim 14, further comprising the step (a-7) of forming a ceramic layer outside a region on said first main surface of said first ceramic green sheet in which the dent is formed prior to said step (a-1).

16. The method of manufacturing a droplet discharge device according to claim 15, wherein a glass transition temperature of said ceramic layer is lower than said glass transition temperature of said first ceramic green sheet.

17. The method of manufacturing a droplet discharge device according to claim 14, further comprising the step (a-8) of forming a through hole piercing from an inner surface of said dent formed on said first main surface of said first ceramic green sheet to a second main surface after said step (a-4).

18. The method of manufacturing a droplet discharge device according to claim 14, wherein said step (b) includes the steps of:

(b-1) forming a photosensitive film on said first main surface of said substrate;

(b-2) irradiating light from a second main surface side of said substrate, and rendering a latent image obtained by transferring a shape in plan view of said cavity in said photosensitive film;

(b-3) removing said photosensitive film formed in a region in which a film of a lowermost layer forming said vibrator by development;

(b-4) forming said film of said lowermost layer forming said vibrator in a region in which said photosensitive film is removed; and (b-5) removing said photosensitive film remaining outside said region in which said film of said lowermost layer forming said vibrator is formed.

* * * * *